US006620502B1

(12) United States Patent
Fujimoto et al.

(10) Patent No.: US 6,620,502 B1
(45) Date of Patent: Sep. 16, 2003

(54) POLYTRIMETHYLENE TEREPHTHALATE FIBER AND PROCESS FOR PRODUCING THE SAME

(75) Inventors: Katsuhiro Fujimoto, Nobeoka (JP); Jinichiro Kato, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/030,415

(22) PCT Filed: Jul. 12, 2000

(86) PCT No.: PCT/JP00/04677

§ 371 (c)(1),
(2), (4) Date: Jan. 10, 2002

(87) PCT Pub. No.: WO01/04393

PCT Pub. Date: Jan. 18, 2001

(30) Foreign Application Priority Data

Jul. 12, 1999 (JP) ..... 11-197160
Feb. 4, 2000 (JP) ..... 2000-027690

(51) Int. Cl.[7] ..... B32B 19/00
(52) U.S. Cl. ..... 428/357
(58) Field of Search ..... 428/364, 395; 57/245, 247; 264/172.17

(56) References Cited

U.S. PATENT DOCUMENTS 4,159,617 A 7/1979 Allan ..... 57/247
6,284,370 B1 * 9/2001 Fujimoto et al. ..... 428/364
6,468,655 B1 * 10/2002 Kato et al. ..... 428/395

FOREIGN PATENT DOCUMENTS

| | | |
|---|---|---|
| JP | 62-223372 | 10/1987 |
| JP | 3-119180 | 5/1991 |
| JP | 7-310241 | 11/1995 |
| JP | 11-93026 | 4/1999 |
| WO | WO 99/14407 | 3/1999 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

A polytrimethylene terephthalate fiber, a method for producing the same, a cheese-shaped package formed thereof, a false-twist textured yarn using the fiber and a fabric using the false-twist textured yarn are provided. The fiber is composed of 90 mol % or more of trimethylene terephthalate repeating units having a density in a range from 1.320 to 1.340 g/cm$^3$, a birefringence in a range from 0.030 to 0.070, a peak value of thermal stress in a range from 0.01 to 0.12 cN/dtex, a boiling water shrinkage in a range from 3 to 40%, and an elongation at break in a range from 40 to 140%. The inventive polytrimethylene terephthalate fiber has both of proper crystallinity and orientation and is free from the package tightness due to yarn shrinkage and the bulge. The inventive fiber can be produced on an industrial scale.

24 Claims, 7 Drawing Sheets

POLYTRIMETHYLENE TEREPHTHALATE FIBER AND PROCESS FOR PRODUCING THE SAME

TECHNICAL FIELD

The present invention relates to a polytrimethylene terephthalate fiber suitable for the high-speed draw false-twist texturing process and a method for producing the same. More specifically, the present invention relates to a partially oriented polytrimethylene terephthalate fiber capable of being subjected to the draw false-twist texturing process, in a stable manner and for a long period, and a method for production thereof.

BACKGROUND ART

A fiber using polytrimethylene terephthalate (hereinafter referred to as PTT) obtained from the polycondensation of terephthalic acid or a lower alcoholic ester of terephthalic acid; typically dimethyl terephthalate; with trimethylene glycol (1,3-propanediol) is an epoch-making fiber having properties similar to polyamide, such as a low elastic modulus (soft touch), excellent elastic recovery and a good dyeability as well as properties similar to polyethylene terephthalate (hereinafter referred to as PET), such as those excellent in resistance to light, heat settability and dimensional stability and a low water-absorption, and used for a BCF carpet, a brush, a tennis racket string or others (for example, see the U.S. Pat. Nos. 3,584,108 and 3,681,188, J. Polymer Science; Polymer Physics (Vol. 14, pages 263 to 274, Published in 1976), Chemical Fibers International (Vol. 45, pages 110 to 111, Published in April 1995), and Japanese Unexamined Patent Publication (Kokai) Nos. 9-3724, 8-173244 and 5-262862).

One of fibrous aspects in which the above-mentioned properties of PTT are maximally exhibited is a false-twist textured yarn. The false-twist textured yarn of PTT is excellent in elastic recovery and softness in comparison with the conventional false-twist textured yarn of PET or polybutylene terephthalate (hereinafter referred to as PBT) and is extremely suitable for a raw yarn of a stretchable material, as disclosed in Japanese Unexamined Patent Publication (kokai) Nos. 9-78373 and 11-093026.

When the PTT false-twist textured yarn is used while applying the above-mentioned properties thereof to various fields in which PET or polyamide fiber have been conventionally used, it is very important to facilitate the productivity of the PTT false-twist textured yarn and reduce the production cost thereof. However, since a drawn yarn produced through a two-stage process including the spinning and the drawing is used as a raw yarn to be subjected to the false-twist texturing process in such prior arts as disclosed in the above Publications, the productivity becomes lower to increase the production cost of the fiber. Also, since the drawn yarn is used as a raw yarn, it is impossible to apply thereto a draw false-twist texturing process which can be carried out at a high speed and a high productivity.

To facilitate the productivity and reduce the production cost, it is desirable to use a fiber produced through a single stage process similar to PET fiber or polyamide fiber and carry out the draw false-twist texturing at a high speed.

A technology for carrying out the draw false-twist texturing of PTT fiber produced through a single stage process is disclosed in Chemical Fibers International (Vol. 47, pages 72 to 74, published in February 1997) wherein a partially oriented yarn (hereinafter referred to as POY) of PTT is subjected to a draw false-twist texturing process. More specifically, PTT polymer having an intrinsic viscosity [η] of 0.9 is extruded at a temperature in a range from 250 to 275° C., cooled and solidified, and after being imparted with a finishing agent, taken up as POY of PTT (hereinafter referred to as PTT-POY) via a godet roll or no godet roll at a speed in a range from 600 to 3200 m/min, which is then subjected to a false-twist texturing process at a speed in a range from 450 to 1100 m/min.

Also, in Korean Unexamined Patent Publication No. 98049300, there is a description of a method for producing PTT-POY by spinning a polymer having an intrinsic viscosity in a range from 0.75 to 1.1 at a spinning speed in a range from 2500 to 5500 m/min and a technology for false-twist texturing this PTT-POY at a temperature in a range from 150 to 160° C. and at a processing speed of 400 m/min. In Japanese Unexamined Patent Publication (Kokai) No. 57-193534, there is a description of PTT-POY obtained by spinning a polymer having an intrinsic viscosity [η] of 0.97 at a spinning speed in a range from 2500 to 3000 m/min.

According to a study made by the present inventors, however, the PTT-POYs described in the above documents or Patent Publications have a drawback in that the yarn largely shrinks on a bobbin on which it is wound so as to tighten the bobbin, and if an amount of the yarn corresponding to that of PET fiber usually adopted in an industrial scale is wound, the bobbin largely deforms to prevent a cheese-shaped package from being removed from a spindle of a winder. Under the circumstances, even if the deformation of the bobbin could be mitigated by using a bobbin of a large mechanical strength, there would be a so-called bulge phenomenon in which opposite lateral sides of the package are swollen outward, or the yarn would be tightly wound in the inner layers. Accordingly, a yarn tension becomes higher and fluctuates largely when the yarn is unwound, and fluff and/or yarn breakage frequently occur during the draw false-twist texturing process, as well as irregularities of crimping or dying may be generated.

A technology for fixing a fibrous structure is disclosed in Japanese Examined Patent Publication (Kokoku) No. 63-42007, wherein a polymer prepared by blending PET with PTT and/or PBT is melted and extruded, which, after being cooled and solidified, is heat-treated by a hot roller and taken up at a speed of 3500 m/min or higher to result in a fiber having an elongation at break of 60% or lower and a shrinkage in boiling water of 7% or lower.

In this Publication, another fiber is disclosed as a comparative example, obtained from PTT homopolymer, and a polymer prepared by blending 10 wt % of PET with PTT homopolymer which is then heated at 180° C. in the same manner as the above and taken up at a speed of 4000 m/min to have an elongation at break of 33% and a shrinkage in boiling water of approximately 4%. Also in this Publication, a high speed spinning in which the fiber is heated by a roller and PTT fiber obtained thereby are described. However, the technology disclosed in this Publication is one for suppressing the shrinkage by facilitating the crystallization of the resultant fiber when the fiber is used for clothing as it is so that the crepability is improved.

According to the study made by the present inventors, if the fiber is heat-treated at a temperature as high as 180° C. or more, the bulge or collapse of yarn coils in the package may frequently occur. Also, since such a fiber is heat-treated at a high temperature to have a low elongation at break of 60% or lower which is similar to that of the drawn fiber, it is impossible to carry out the draw false-twist texturing of the fiber.

Regarding the polyamide type POY, Japanese Unexamined Patent Publication (Kokai) No. 50-71921 discloses the technology for obtaining a package free from the collapse of yarn coils by heat-treating the fiber with a hot roller. If the polyamide POY is not crystallized, it is liable to extend due to moisture absorption to cause the collapse of yarn coils. The technology disclosed in this Publication is to solve such a collapse of yarn coils.

In Japanese Unexamined Patent Publication (Kokai) No. 51-47114, a technology is disclosed wherein a fiber spun at a high speed is heat-treated under a tense state through a hot roller to crystallize the same, whereby the elongation at break of the fiber is lowered and the ease of false-twisting the fiber is improved. The technology disclosed in this Publication, however, aims to lower the elongation at break of the fiber and improve the crimpability thereof.

In other words, the technologies disclosed in both the Publications aim to achieve objects different from the improvement in package tightness due to fiber shrinkage, the restriction of bulge phenomenon and the suppression of change in fiber property with time, and therefore are useless with respect to the improvement in fiber shrinkage in a package or in the bulge generation of PTT fiber.

It has been thought, in the prior art, that, different from the polyamide type fiber, when the polyester type fiber is heated and crystallized so that the fibrous structure thereof is fixed, crystals disturb the movement of the fiber molecules to interfere with the smooth draw false-twist texturing process. Therefore, the technologies for heat-treating POY disclosed in the above Unexamined Patent Publications have not been applied to the polyester type fiber.

As described hereinabove, there is no PTT-POY free from the generation of fiber shrinkage and bulge in a package and capable of being subjected to the draw false-twist texturing process in a stable manner for a long period.

DISCLOSURE OF THE INVENTION

According to the study made by the present inventors, it was found that there are problems in the prior art PTT-POY and the production thereof as follows:

(A) A wound yarn shrinks to tighten a bobbin whereby it becomes impossible to remove a cheese-shaped yarn package from a spindle of a winder or a bulge may occur in the package. Accordingly, it is impossible to obtain a cheese-shaped package having the same amount of yarn as the industrially produced PET.

(B) Since physical properties of PTT-POY such as a shrinkage in boiling water or a peak value of thermal stress may vary even if it is stored at room temperature, it is impossible to industrially carry out the draw false-twist texturing; i.e., to produce the same quality false-twist textured yarn in a stable manner for a long period under the invariable condition without the generation of fluff or yarn breakage.

From the study of the reasons why the fiber shrinks as described above, the present inventors found that the following two items are decisive.

(1) Since PTT is of a zigzag molecular structure which is different from PET, a glass transition point (hereinafter referred to as Tg) is as low as 30 to 50° C. and, if it is not crystallized as in a drawn yarn, the structure thereof is not fixed so that molecules are mobile even at a room temperature to result in shrinkage.

(2) Since the elastic recovery of PTT fiber is high, a stress caused by the winding remains as it is without being released.

In the above-mentioned prior art, there has been no suggestion at all that such a problem may occur.

According to the study made by the present inventors, physical properties of PET-POY hardly vary if it has been stocked at a room temperature. Contrarily, in PTT-POY disclosed in the above-mentioned prior art, physical properties such as a shrinkage in boiling water or a peak value of thermal stress may vary with time. Accordingly, it is impossible to industrially carry out the draw false-twist texturing; i.e., to produce the same quality false-twist textured yarn in a stable manner for a long period under the invariable condition without the generation of fluff or yarn breakage.

An object of the present invention is to provide a PTT fiber obtainable on an industrial scale and capable of being subjected to a draw false-twist texturing process in a stable state for a long period; i.e., PTT-POY, and a method for producing the same.

Problems to be solved for the purpose of achieving the object of the present invention are to obtain PTT-POY lower in package tightness and generation of bulge phenomenon caused by fiber shrinkage and capable of being produced on an industrial scale as a countermeasure to the above-mentioned (A), and to obtain PTT-POY free from change in physical properties with time at a room temperature and capable of being subjected to a draw false-twist texturing process on an industrial scale as a countermeasure to the above-mentioned (B).

To solve the above problems, the present inventors have diligently studied and found that the generation of package tightness and the bulge phenomenon, which are decisive problems during the production of PTT-POY, caused by the fiber shrinkage is surprisingly avoidable, if the fiber has a specific range of orientation and crystallinity. Also, the inventors have found that such a fiber is favorably produced by a specific spinning method wherein the fiber is heat-treated and crystallized under a special condition and wound at an extremely low tension.

Further surprisingly, it has been found that, different from PET fiber, the fiber having the orientation and crystallinity in a range defined according to the present invention is capable of being subjected to a draw false-twist texturing process to result in a false-twist textured yarn excellent in quality grade even if it is heat-treated to be crystallized. Furthermore, since the fiber structure of PTT according to the present invention is fixed due to the crystallization, the physical properties thereof hardly vary with time, whereby it is possible to produce a false-twist textured yarn having the same quality grade in a stable state without the generation of fluff and yarn breakage.

That is, the present invention is as follows:

1. A polytrimethylene terephthalate fiber composed of 90 mol % or more of trimethylene terephthalate repeating units and satisfying the following conditions defined in (A) to (E):
   (A) a density is in a range from 1.320 to 1.340 g/cm$^3$
   (B) a birefringence is in a range from 0.030 to 0.070
   (C) a peak value of thermal stress is in a range from 0.01 to 0.12 cN/dtex
   (D) a shrinkage in boiling water is in a range from 3 to 40%, and
   (E) an elongation at break is in a range from 40 to 140%.
2. A PTT fiber as defined by above item 1, wherein an intensity of a wide angle X-ray diffraction in the direction vertical to a fiber axis satisfies the following equation:

$$I_1/I_2 \geqq 1.0$$

wherein $I_1$ is a maximum diffraction intensity defined at 2θ=15.5 to 16.5 degrees, and $I_2$ is a mean diffraction intensity defined at 2θ=18 to 19 degrees.

3. A PTT fiber as defined by above items 1 or 2, wherein an oil satisfying the following conditions defined in (P) to (S) is adhered to the fiber in a range from 0.2 to 3 wt %:
   (P) the content of one kind or more of nonionic surfactants is in a range from 5 to 50 wt %, selected from compounds in which alcohol having 4 to 30 carbon atoms is added with ethylene oxide or propylene oxide;
   (Q) the content of ionic surfactant is in a range from 1 to 8 wt %;
   (R) one kind or more of fatty ester having a molecular weight in a range from 300 to 700 and/or one kind or more of polyether represented by the following formula (referred to as polyether-1) are contained; in the polyether-1, ethylene oxide unit and propylene oxide unit are copolymerized with each other so that a mass ratio of [propylene oxide unit]/[ethylene oxide unit] is in a range 20/80 to 70/30 and a molecular weight is in a range from 1300 to 3000, wherein a total of contents of the fatty ester and the polyether-1 is in a range from 40 to 70 wt %:

$$R_1—O—(CH_2CH_2O)_{n1}—(CH(CH_3)CH_2O)_{n2}—R_2$$

(wherein $R_1$, $R_2$ represent a hydrogen atom or an organic group having the number of carbons in a range from 1 to 50, and n1, n2 are an integer in a range from 1 to 50); and
   (S) the content of polyether represented by the following formula (referred to as polyether 2) is 10 wt % or less, in which ethylene oxide unit and propylene oxide unit are copolymerized with each other so that a mass ratio of [propylene oxide unit]/[ethylene oxide unit] is in a range 20/80 to 80/20 and a molecular weight is in a range from 5000 to 50000:

$$R_3—O—(CH_2CH_2O)_{n1}—(CH(CH_3)CH_2O)_{n2}—R_4$$

(wherein $R_3$, $R_4$ represent a hydrogen atom or an organic group having the number of carbons in a range from 1 to 50, and n1, n2 are each an integer in a range from 50 to 1000).

4. A PTT fiber as defined by any one of above items 1 to 3, wherein a coefficient G of static friction corrected by a fiber size is in a range from 0.06 to 0.25; the coefficient G is calculated from a coefficient F/Fμs of fiber-fiber static friction and a total fiber size d (dtex), as is represented by the following equation (1):

$$G=(F/F\mu s)-0.00383\times d \quad (1)$$

5. A PTT fiber as defined by above item 4, wherein a coefficient F/Mμd of dynamic friction between fiber and metal is in a range from 0.15 to 0.30.

6. A PTT fiber as defined by any one of above items 1 to 5, wherein the following conditions defined in (F) and (G) are satisfied:
   (F) the content of titanium oxide having an average particle size in a range from 0.01 to 2 μm is in a range from 0.01 to 3 wt %, and the number of aggregates of the titanium oxide particles having the longest length exceeding 5 μm is 12/mg of fiber or less; and
   (G) the fiber has U % in a range from 0 to 2%.

7. A PTT fiber composed of 90 mol % or more of trimethylene terephthalate repeating units, satisfying the following conditions defined in (H) to (K), and wound to form a cheese-shaped package:
   (H) a birefringence is in a range from 0.030 to 0.070
   (I) a peak value of thermal stress is in a range from 0.01 to 0.12 cN/dtex
   (J) an intensity of a wide angle X-ray diffraction in the direction vertical to a fiber axis satisfies the following equation:

$$I_1/I_2 \geqq 1.0$$

wherein $I_1$ is a maximum diffraction intensity defined by 2θ=15.5 to 16.5 degrees, and $I_2$ is a mean diffraction intensity defined by 2θ=18 to 19 degrees; and
   (K) a relaxed shrinkage is in a range from 0 to 3%.

8. A cheese-shaped package formed of the PTT fiber defined by any one of above items 1 to 7, wherein a bulging percentage is 20% or less.

9. A cheese-shaped package as defined by above item 8, wherein the released shrinkage of the PTT fiber wound thereon is in a range from 0 to 3%.

10. A cheese-shaped package as defined by above items 8 or 9, wherein a width within which the PTT fiber is wound on a bobbin is in a range from 40 to 300 mm and a weight of the PTT fiber wound on the bobbin is 2 kg or more.

11. A method for producing a PTT fiber by melt-spinning PTT composed of 90 mol % or more of trimethylene terephthalate repeating units, wherein a melted multifilamentary yarn extruded from a spinneret is quickly cooled to be a solidified multifilamentary yarn which, after being heated to a temperature in a range from 50 to 170° C., is then wound on a bobbin at a winding tension in a range from 0.02 to 0.20 cN/dtex and a speed in a range from 2000 to 4000 m/min.

12. A method for producing a PTT fiber, as defined by above item 11, wherein after the melted multifilamentary yarn extruded from the spinneret has been quickly cooled to be the solidified multifilamentary yarn, an oil is imparted to the multifilamentary yarn before being wound on the bobbin at a pickup in a range from 0.2 to 3 wt % relative to the multifilamentary yarn.

13. A method for producing a PTT fiber as defined by above item 12, wherein the oil satisfying the following conditions defined by (P) to (S) is imparted:
   (P) the content of one kind or more of a nonionic surfactant is in a range from 5 to 50 wt %, which surfactant is selected from compounds composed of alcohol having the number of carbons in a range from 4 to 30 added with ethylene oxide or propylene oxide;
   (Q) the content of an ionic surfactant is in a range from 1 to 8 wt %;
   (R) one kind or more of fatty ester having a molecular weight in a range from 300 to 700 and/or one kind or more of polyether represented by the following formula (referred to as polyether-1) are contained, in the polyether-1, ethylene oxide unit and propylene oxide unit are copolymerized with each other so that a mass ratio of [propylene oxide unit]/[ethylene oxide unit] is in a range 20/80 to 70/30 and a molecular weight is in a range from 1300 to 3000, wherein a total of contents of the fatty ester and the polyether-1 is in a range from 40 to 70 wt %:

$$R_1—O—(CH_2CH_2O)_{n1}—(CH(CH_3)CH_2O)_{n2}—R_2$$

(wherein $R_1$, $R_2$ represent a hydrogen atom or an organic group having the number of carbons in a range from 1 to 50, and n1, n2 are each an integer in a range from 1 to 50); and (S) the content of polyether represented by the following formula (referred to as polyether-2) is 10 wt % or less, in which ethylene oxide unit and propylene oxide unit are copolymerized with each other so that a mass ratio of [propylene oxide unit]/[ethylene oxide unit] is in a range from 20/80 to 80/20 and a molecular weight is in a range from 5000 to 50000:

$$R_3—O—(CH_2CH_2O)_{n1}—(CH(CH_3)CH_3O)_{n2}—R_4$$

(wherein $R_3$, $R_4$ represent a hydrogen atom or an organic group having the number of carbons in a range from 1 to 50, and n1, n2 are each an integer in a range from 50 to 1000).

14. A method for producing a PTT fiber as defined by any one of above items 11 to 13, wherein the fiber is imparted with an oil by an aqueous emulsion of a concentration in a range from 2 to 10 wt %.

15. A method for producing a PTT fiber as defined by any one of above items 11 to 14, wherein a polymer satisfying the following condition defined in (L) is extruded from the spinneret so that a draft during the spinning process is in a range from 60 to 2000:

(L) the content of titanium oxide having an average particle size in a range from 0.01 to 2 $\mu$m is in a range from 0.01 to 3 wt %, and the number of aggregates of the titanium oxide particles having the longest length exceeding 5 $\mu$m is 25/mg of polymer or less.

16. A false-twist textured yarn formed of a PTT fiber as defined by any one of above items 1 to 7.

17. A false-twist textured yarn formed of a PTT fiber composed of 90 mol % or more of trimethylene terephthalate repeating units and satisfying the following conditions defined in (M) to (O):

(M) a crimp elongation is in a range from 150 to 300%;

(N) the number of crimps is in a range from 4 to 30/cm; and (O) the number of snarls is in a range from 0 to 3/cm.

18. A false-twist textured yarn as defined by above item 17, wherein the number of crimps is in a range from 8 to 25/cm.

19. A false-twist textured yarn as defined by any one of above items 16 to 18, wherein the following condition defined in (K) is satisfied:

(K) the content of titanium oxide having an average particle size in a range from 0.01 to 2 $\mu$m is in a range from 0.01 to 3 wt %, and the number of aggregates of the titanium oxide particles having the longest length exceeding 5 $\mu$m is 12/mg of fiber or less.

20. A false-twist textured yarn as defined by any one of above items 16 to 19, wherein an oil containing fatty ester having a molecular weight in a range from 300 to 800 and/or mineral oil having a Redwood viscosity at 30° C. in a range from 20 to 100 seconds is adhered to the false-twist textured yarn at a pickup in a range from 0.5 to 5 wt % relative to the false-twist textured yarn.

21. A false-twist textured yarn package, wherein the false-twist textured yarn defined by any one of above items 16 to 20 is wound on a bobbin.

22. A false-twist textured yarn package as defined by above item 21, wherein a hardness of the package is in a range from 70 to 90 and a winding density is in a range from 0.6 to 1.0 g/cm$^3$.

23. A method for producing a false-twist textured yarn, wherein the PTT fiber as defined by any one of above items 1 to 7 is subjected to a draw false-twist texturing process.

24. A method for producing a false-twist textured yarn, wherein the cheese-shaped package as defined by any one of above items 8 to 10 is subjected to a draw false-twist texturing process.

25. A fabric wherein the false-twist textured yarn as defined by any one of above items 16 to 20 is used as part or all thereof.

DETAILED DESCRIPTION OF THE INVENTION

Figure 1A:
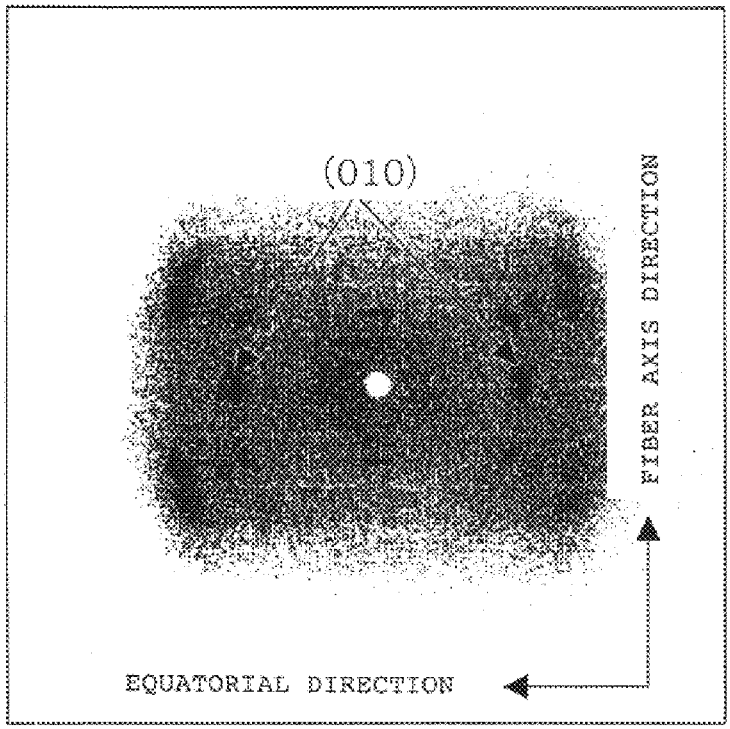
FIG. 1(A) is an illustration of a wide angle X-ray diffraction image in which a diffraction image due to the crystallization is observed.

Details of the present invention will be described below.

(1) Polymer Material (i) The polymer used for the present invention is PTT (polytrimethylene terephthalate) composed of 90 mol % or more of trimethylene terephthalate repeating units.

In this regard, PTT is a polyester having an acidic component of terephthalic acid and a diol component of trimethylene glycol (also referred to as 1,3-propanediol).

Other copolymerized components may be contained in this PTT provided they are at 10 mol % or less. Such copolymerized components include an ester-forming monomer such as 5-sodium sulfoisophthalate, 5-potassium sulfoisophthalate, 4-sodium sulfo-2,6-naphthalene dicarboxylic acid, 3,5-dicarboxy benzene sulfonate tetramethylphosphonium salt, 3,5-dicarboxy benzene sulfonate ammonium salt, 1,2-butane diol, 1,3-butane diol, 1,4-butane diol, neopentyl glycol, 1,6-hexamethylene glycol, 1,4-cyclohexane diol, 1,4-cyclohexane dimethanol, succinic acid, adipic acid, sebacic acid, dodecanic diacid, fumaric acid, maleic acid, or 1,4-cyclohexane dicarboxylic acid.

(ii) The polymer used for the present invention preferably contains, in a range from 0.01 to 3 wt %, titanium oxide having an average particle size of 0.01 to 2 $\mu$m for the purpose of suppressing the generation of fluff and yarn breakage during the spinning or the post treatment, wherein the number of aggregates of the titanium oxide particles having the longest length exceeding 5 μm is 25/mg of polymer (this unit represents the number of aggregates in 1 mg of polymer) or less.

Such a polymer is suitably obtained by adding a solution to a reaction product at optional stages of the polymerization to complete the polycondensation reaction, which solution is prepared by adding titanium oxide particles to a solvent, agitating the same and removing the aggregates of the titanium oxide particles through a centrifugal separator or a filter.

Titanium oxide used for the present invention is preferably of an anatase type on account of its low hardness and a good dispersibility to a solvent. Also, the average particle size of titanium oxide is preferably in a range from 0.01 to 2 μm, more preferably from 0.05 to 1 μm. One having an average particle size of less than 0.01 μm is practically difficult to be obtained and liable to form aggregates. On the other hand, one having the average particle size exceeding 2 μm may have aggregates having a longest length of more than 5 μm. While there is no limitation in the distribution of particle size of titanium oxide used, a share of the particle size of 1 μm or more is preferably 20 wt % or less, more preferably 10 wt % or less.

Titanium oxide used for the present invention is dispersed into a solvent. Although it may be dispersed at once into water or alcohol used as a solvent, it is preferably dispersed into 1,3-propane diol because it is necessarily added to a high temperature polymerization reaction system.

While aggregates may be removed from titanium oxide dispersed into the solvent solely by a centrifugal separator or a filter, to further lessen the aggregates, it is favorable to remove the same through another filter or the like after the centrifugal separation. The filter which can remove the aggregates more than 5 μm is preferable.

The dispersed solution of titanium oxide thus obtained is preferably agitated or shaken until it is added to the reaction product. This is because titanium oxide is liable to precipitate and aggregate in 1,3-propane diol, which should be suppressed.

While a dispersed solution of titanium oxide may be added to the reaction product at optional stages of the polymerization, it is preferably added for the purpose of suppressing the aggregation of titanium oxide after the completion of esterification reaction or ester exchange reaction and before the polycondensation reaction starts, so that the reaction product has not yet experienced a thermal history for a long period and has a viscosity under which titanium oxide is favorably dispersible in the reaction product.

The polymer used for the present invention may be mixed or copolymerized if necessary with various additives, such as a heat stabilizer, an anti-foaming agent, a color modifier, a fire retardant, an anti-oxidant, an ultraviolet absorber, an infrared absorber, a crystallizing nucleus, a fluorescent brightener, or a delustering agent other than titanium oxide.

(iii) An intrinsic viscosity [η] of the polymer used for the present invention is preferably in a range from 0.5 to 1.4, more preferably from 0.7 to 1.2 on account of the strength and the spinnability of the resultant fiber.

If the intrinsic viscosity is less than 0.5, the molecular weight of the polymer becomes so low that fluff or yarn breakage is liable to generate during the spinning or the post-treatment, or sometimes it is difficult to develop the required strength in a false-twist textured yarn. On the contrary, if the intrinsic viscosity exceeds 1.4, the melting viscosity becomes so high that the melt fracture or a disturbance may occur during the spinning.

(iv) The polymer used for the present invention can be produced by known methods.

For example, terephthalic acid or dimethyl terephthalate and trimethylene glycol are used as raw materials, to which one kind or more of metallic salt is added to the polymer in a range from 0.03 to 0.1 wt %, which metallic salt is, for example, titanium tetrabutoxide, titanium tetraisopropoxide, calcium acetate, magnesium acetate, zinc acetate, cobalt acetate, manganic acetate, a mixture of titanium dioxide and silicon dioxide, to obtain bis-hydroxypropyl terephthalate under a normal or positive pressure at an esterification percentage in a range from 90 to 98%, which is then added with one kind of catalyst or more, such as titanium tetraisopropoxide, titanium tetrabutoxide, antimony trioxide and antimony acetate, in a range from 0.02 to 0.15%, preferably from 0.03 to 0.1 wt % and reacted therewith under a negative pressure at a temperature in a range from 250 to 270° C.

(v) At an optional stage in the polymerization, preferably before the polycondensation reaction, a stabilizer is preferably added on account of improving the whiteness and the melting stability and controlling the generation of organic compound having as low molecular weight as 300 such as PTT oligomer, acrolein or allyl alcohol.

The stabilizer used in this case is preferably pentavalent and/or trivalent phosphoric compounds or hindered phenolic type compounds.

The pentavalent and/or trivalent phosphoric compounds include trimethyl phosphate, triethyl phosphate, tributyl phosphate, triphenyl phosphate, trimethyl phosphite, triethyl phosphite, tributyl phosphite, triphenyl phosphite, phosphoric acid, phosphorous acid or others. Of them, trimethyl phosphite is particularly favorable.

The hindered phenolic type compounds are phenolic type derivatives with a substituent having steric hindrance at a position adjacent to a phenolic type hydroxyl group and having one ester linkage or more in one molecule. Concretely, they include pentaerythritol-tetrakis[3-(3,5-di-tert-butyl-4-hydoxyphenyl)propionate], 1,1,3-tris-(2-methyl-4-hydroxy-5-tert-butylphenyl)butane, 1,3,5-trimethyl-2,4,6-tris(3,5-di-tert-butyl-4-hydroxybenzyl)benzene, 3,9-bis[2-[3-(3-tert-butyl-4-hydroxy-5-methylphenyl)propionyloxy]-1,1-dimethylethyl]-2,4,8,10-tetraoxaspiro[5,5]undecane, 1,3,5-tris(4-tert-butyl-3-hydroxy-2,6-dimethylbenzene)isophthalate, triethylglycol-bis[3-(3-tert-butyl-5-methyl-4-hydroxyphenyl)propionate], 1,6-hexanediol-bis[3-(3,5-di-tert-butyl-4-hydroxyphenyl)propionate], 2,2-thio-diethylene-bis[3-(3,5-di-tert-butyl-4-hydroxyphenyl)propionate] and octadecyl-3-(3,5-di-tert-butyl-4-hydroxyphenyl)propionate]. Of them, pentaerythritol-tetrakis[3-(3,5-di-tert-butyl-4-hydoxyphenyl)propionate] is particularly favorable.

(2) PTT Fiber (I) The PTT fiber according to the present invention must satisfy the following required conditions defined in (A) to (E).

(A) a density: 1.320 to 1.340 g/cm$^3$ (B) a birefringence: 0.030 to 0.070

(C) a peak value of thermal stress: 0.01 to 0.12 cN/dtex (D) a shrinkage in boiling water: 3 to 40%

(E) an elongation at break: 40 to 140%

To eliminate the package tightness due to fiber shrinkage which is one of problems to be solved by the present invention, it is important that the fiber is crystallized so that fiber molecules are fixed and the molecules are not excessively oriented in the tensed state.

To produce the false-twist textured yarn of the same quality for a long time under the same conditions in a stable manner without the generation of fluff and yarn breakage, which is another problem of the present invention, it is important that the fiber has an elongation at break in a predetermined range and also has an elongation at break, a peak value of thermal stress and a shrinkage in boiling water invariable with time.

To do so, it is necessary that the fiber is properly crystallized to fix the molecules thereof and the molecules are not excessively oriented to be in a tense state. Accordingly, to solve all such problems, it is necessary for the fiber to be of a special structure having a crystallinity and an orientation in a specific range.

As an index for indicating the crystallinity, the measurement of the fiber density is suitable. Since the density in the crystalline region is larger than that in the amorphous region, it can be said that the larger the density, the higher the crystallinity.

As an index for indicating the orientation, the birefringence of the fiber is suitable.

As indices for indicating the orientation, the tense state and the fixed state of molecules which are largely related to the package tightness due to fiber shrinkage, the processibility for the draw false-twist texturing process and the variation with time, the peak value of thermal stress, the shrinkage in boiling water and the elongation at break of the fiber are suitable.

Accordingly, when the above-mentioned ranges of the density, the birefringence, the peak value of thermal stress, the shrinkage in boiling water and the elongation at break of the fiber are satisfied, it is possible to obtain PTT-POY which can be produced in an industrial scale without the generation of package tightness due to fiber shrinkage and bulging and be subjected to the draw false-twist texturing process for a long time in a stable manner because there is no variation of physical properties with time.

(i) Density (A)

The fiber density must be in a range from 1.320 to 1.340 g/cm$^3$.

If the density exceeds 1.340 g/cm$^3$, the collapse of yarn coils may occur. The reason therefor is indefinite, but it is conceivable that the fiber itself or the surface thereof becomes harder due to the development of the crystallinity of the fiber, and therefore a contact area between fibers is smaller to decrease the coefficient of fiber-fiber static friction. Also, the generation of fluff or yarn breakage increases during the draw false-twist texturing process, whereby it is difficult to carry out the draw false-twist texturing process in an industrial scale in a stable manner.

On the other hand, if the density is less than 1.320 g/cm$^3$ which means that the crystallinity is insufficient for the fixation of the fiber, there may be the package tightness due to fiber shrinkage after the winding or the variation of fiber physical properties with time, whereby it is sometimes difficult to obtain the false-twist textured yarn of the same quality for a long time under the same conditions.

The density is preferably in a range from 1.322 to 1.336 g/cm$^3$, more preferably from 1.326 to 1.334 g/cm$^3$.

(ii) Relationship Between Birefringence (B) and Peak Value of Thermal Stress (C)

It is necessary that the fiber birefringence is in a range from 0.030 to 0.070, and the peak value of thermal stress is in a range from 0.01 to 0.12 cN/dtex.

If either the fiber birefringence exceeds 0.070 or the peak value of thermal stress exceeds 0.12 cN/dtex, a shrinking force of the fiber is so large that the fiber largely shrinks after being wound, whereby the package tightness due to fiber shrinkage is liable to occur.

If either the fiber birefringence is less than 0.030 or the peak value of thermal stress is less than 0.01 cN/dtex, the orientation is so low that no crystallinity of the fiber is recognized, whereby physical properties of the fiber such as the shrinkage in boiling water will vary with time even if the fiber is stored at a room temperature. If the fiber has been heat-treated to develop the crystallinity for the purpose of suppressing the variation of physical properties thereof with time, the fiber becomes brittle. Accordingly, either of the countermeasures is not suitable for the draw false-twist texturing process in an industrial scale.

The fiber birefringence is preferably in a range from 0.035 to 0.065, more preferably from 0.040 to 0.060. The peak value of thermal stress is preferably in a range from 0.015 to 0.10 cN/dtex, more preferably from 0.02 to 0.08 cN/dtex.

A temperature at which the peak value of thermal stress is exhibited is preferably in a range from 50 to 80° C. If this value is lower than 50° C., the fiber largely shrinks after being wound to result in the package tightness due to fiber shrinkage. If it exceeds 80° C., fluff and yarn breakage are liable to occur during the draw false-twist texturing process. The temperature at which thermal stress exhibits the peak value is more preferably from 55 to 75° C., most preferably from 57 to 70° C.

(iii) Shrinkage in Boiling Water (D)

It is necessary that the shrinkage in boiling water of the fiber is in a range from 3 to 40%.

If the shrinkage in boiling water exceeds 40%, this means that the crystallization has not been developed whereby the fiber structure is not fixed. Accordingly, even if stored at a room temperature, the physical properties of the fiber such as the shrinkage in boiling water or the peak value of thermal stress may vary, whereby it is difficult to produce the false-twist textured yarn of the same quality for a long time at the same conditions without the generation of fluff and yarn breakage. Contrarily, if the shrinkage in boiling water is less than 3%, the fiber becomes brittle to increase the generation of fluff and yarn breakage during the draw false-twist texturing process. The shrinkage in boiling water is preferably in a range from 4 to 20%, more preferably from 5 to 15%, and most preferably from 6 to 10%.

(iv) Elongation at Break (E)

It is necessary that the elongation at break of the fiber is in a range from 40 to 140%.

If the elongation at break is lower than 40%, the draw false-twist texturing of the fiber becomes difficult because of the excessively low elongation. Contrarily, if it exceeds 140%, the orientation of the fiber is too low and the crystallization of the fiber is not yet developed, whereby the fiber property is very liable to change with time, or the orientation of the fiber is too low and the crystallization has been developed, whereby the fiber becomes very brittle to make it difficult to industrially carry out the draw false-twist texturing process. The elongation at break is preferably in a range from 50 to 120%, more preferably from 60 to 100%.

The standard deviation of the elongation at break is preferably 10% or less to carry out the draw false-twist texturing process at a high speed in a stable state without fluff and yarn breakage. In this respect, the standard deviation of the elongation at break is determined by the measurement of the elongation at break on twenty fiber samples. If the standard deviation of the elongation at break exceeds 10%, it means that the unevenness of the elongation of the fiber is large; in other words, the fiber has many weak portions; and therefore many fluff and yarn breakage are liable to occur during the draw false-twist texturing process at a high speed. The standard deviation is preferably as small as possible, and 0% is most favorable. The standard deviation of the elongation at break is more preferably 7% or less, particularly preferably 5% or less.

(II) Physical Properties or Others of PTT Fiber (i) Observation of Wide-angle X-ray Diffraction Originated from Crystal According to the present invention, the crystallization of the fiber is favorable, that is, the diffraction originated from crystal is preferably observed in the wide-angle X-ray diffraction image of the fiber. There are two methods for observing the diffraction originated from the crystallization; one using an imaging plate X-ray diffraction apparatus (hereinafter referred to as IP) and one using a counter. While it is possible to observe the diffraction by using either of the methods, the counter method is favorable because of fewer errors.

The wide angle X-ray diffraction will be described in more detail below with reference to the drawings.

Figure 1B:
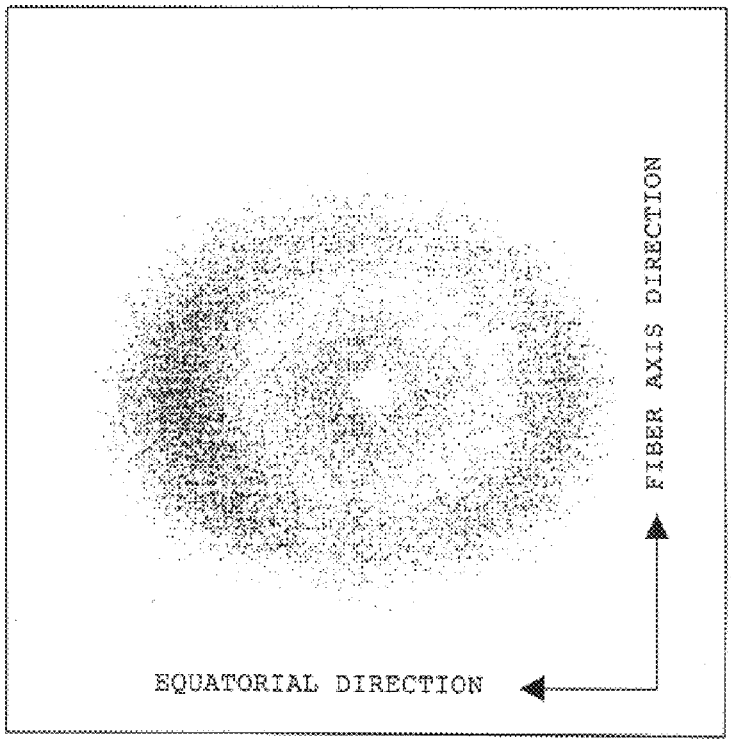
FIG. 1(B) is an illustration of a wide angle X-ray diffraction image in which a diffraction image due to the crystallization is not observed.

As a representative example when X-rays are irradiated in the vertical direction to the fiber by using IP, a diffraction image of the fiber wherein the diffraction image originated from crystal is observed as shown in FIG. 1(A) and that wherein the diffraction image originated from crystal is not observed is shown in FIG. 1(B).

In this case, CuKα-rays are used as the X-rays. It has been known that PTT is of a crystal shape belonging to a triclinic system (see, for example, Polym. Prepr. Jpn., Vol. 26; p427, published in 1997), and therefore, the diffraction images originated from numerous crystals are observed as shown in FIG. 1(A).

According to the present invention, it was judged, as shown in FIG. 1(A), whether there is the diffraction image originated from a crystal face (010) observed in the vicinity of 2θ=15.5 degrees as seen in an equatorial direction. On the other hand, in FIG. 1(B), there are no peaks originated from the crystal as in FIG. 1(A) but only annular halos originated from amorphousness are observed.

Figure 2A:
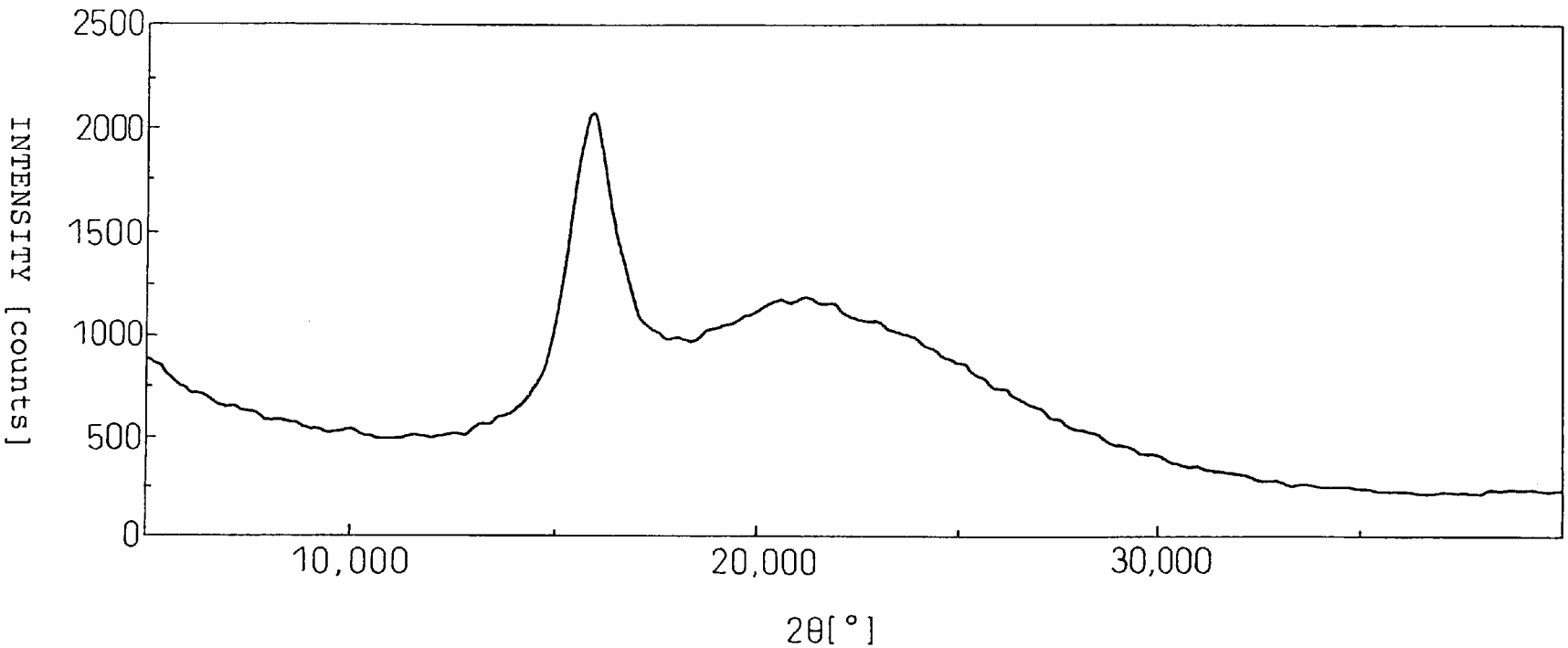
FIG. 2(A) is a chart of a wide angle X-ray diffraction image in which a peak due to the crystallization is observed.
Figure 2B:
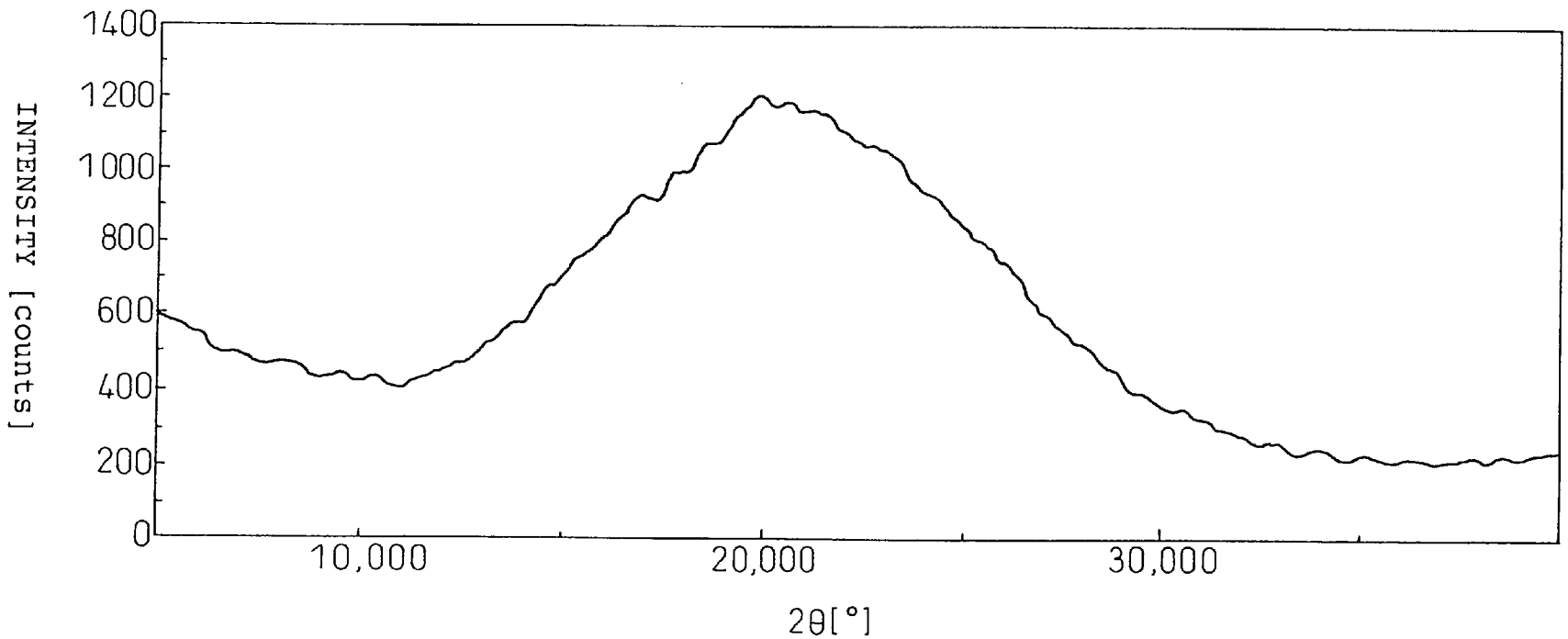
FIG. 2(B) is a chart of a wide angle X-ray diffraction image in which a peak due to the crystallization is not observed.

FIG. 2(A) shows a pattern when the diffraction peak originated from crystal is observed and FIG. 2(B) shows a pattern when the diffraction peak originated from crystal is not observed, which are representatives of the diffraction pattern when X-rays are irradiated in the direction vertical to the fiber and scanned in the linear direction along the fiber axis at an angle of θ-2θ. Also in this case, CuKα-rays are used as the X-rays. Similar to the method wherein the imaging plate X-ray diffraction apparatus is used, the diffraction peak originated from a face (010) is observed in the vicinity of 2θ=15.5 degrees, if the fiber is crystallized.

According to the present invention, as shown in FIG. 2(A), the determination was made whether or not the intensity of diffraction satisfies the following formula when scanned at an angle θ-2θ in the linear direction along the fiber axis.

$$I_1/I_2 \geqq 1.0$$

wherein $I_1$ is a maximum diffraction intensity defined by 2θ=15.5 to 16.5 degrees, and $I_2$ is a mean diffraction intensity defined by 2θ=18 to 19 degrees.

On the other hand, in FIG. 2(B), the peak originated from crystal is not observed as in FIG. 2(A) but a broad diffraction originated from amorphousness only is observed. In such a case, the above-mentioned formula is not satisfied.

If the diffraction peak originated from crystal is observed in the wide angle x-ray diffraction, it is known that the fiber is crystallized and the structure thereof is fixed. If the diffraction originated from crystal is not observed, the fiber is not crystallized. Accordingly, since the fiber molecule is not fixed, the fiber shrinks on the bobbin to cause the package tightness or physical properties of the fiber change with time, whereby the false-twist texturing of the fiber may be impossible in a stable manner for a long time.

The value of $I_1/I_2$ is preferably 1.1 or more, further preferably 1.2 or more.

(ii) Oil

The oil referred to in the present invention is organic compounds to be adhered to a surface of the fiber. Of course, part of the oil may penetrate the interior of the fiber.

The fiber according to the present invention preferably carries the oil satisfying the following required conditions defined in (P) to (S) on the surface thereof in a range from 0.2 to 3 wt % relative to the fiber mass.

(P) the content of one kind or more of nonionic surfactants selected from compounds in which alcohol having 4 to 30 carbon atoms added with ethylene oxide or propylene oxide is in a range from 5 to 50 wt %;

(Q) the content of ionic surfactant is in a range from 1 to 8 wt %;

(R) one kind or more of fatty ester having a molecular weight in a range from 300 to 700 and/or one kind or more of polyether represented by the following formula (referred to as polyether-1) are contained, in the polyether-1, ethylene oxide unit and propylene oxide unit are copolymerized with each other so that a mass ratio of [propylene oxide unit]/[ethylene oxide unit] is in a range 20/80 to 70/30 and a molecular weight is in a range from 1300 to 3000, wherein a total of contents of the fatty ester and the polyether-1 is in a range from 40 to 70 wt %:

$$R_1—O—(CH_2CH_2O)_{n1}—(CH(CH_3)CH_2O)_{n2}—R_2$$

(wherein $R_1$, $R_2$ represent a hydrogen atom or an organic group having 1 to 50 carbon atoms, and n1, n2 are each an integer in a range from 1 to 50); and (S) the content of polyether represented by the following formula (referred to as polyether 2) is 10 wt % or less, in which ethylene oxide unit and propylene oxide unit are copolymerized with each other so that a mass ratio of [propylene oxide unit]/[ethylene oxide unit] is in a range 20/80 to 80/20 and a molecular weight is in a range from 5000 to 50000:

$$R_3—O—(CH_2CH_2O)_{n1}—(CH(CH_3)CH_2O)_{n2}—R_4$$

(wherein $R_3$, $R_4$ represent a hydrogen atom or an organic group having 1 to 50 carbon atoms, and n1, n2 are each an integer in a range from 50 to 1000).

The respective components of the oil will be described below wherein wt % is a ratio relative to a fiber mass.

(a) Required Conditions (P)

Compounds which are a first component of the oil defined by the required conditions (P) are one kind or more of nonionic surfactant in which alcohol having 4 to 30 carbon atoms is added with ethylene oxide or propylene oxide.

Such nonionic surfactants are an emulsifying agent for properly emulsifying the respective oil components to facilitate the fiber cohesiveness and oil stickiness and suitably increase a coefficient of fiber-fiber static friction without injuring the smoothness of PTT fiber so that the yarn coils are prevented from slipping to generate the bulge.

Part or all of hydrogen atoms of the nonionic surfactant may be replaced by hydroxyl groups, groups having hetero atoms such as halogen atoms or elements having hetero atoms. The number of carbon atoms in the alcohol is preferably in a range from 4 to 30, more preferably from 6 to 30 on account of the emulsification and the cohesiveness, further more preferably from 8 to 18. The number of added mols of ethylene oxide or propylene oxide is preferably in a range from 1 to 30, and on account of the improvement in smoothness, more preferably from 3 to 15.

The nonionic surfactant is preferably a saturated alkyl ether composed of aliphatic alcohol having 4 to 30 carbon atoms added with ethylene oxide or propylene oxide. By using such a nonionic surfactant, it is possible to have a favorable effect on both of the improvement in fiber smoothness and the suppression of bulge.

The saturated alkyl ether is preferably a straight-chain alkyl ether if more smoothness is required in accordance with process conditions of fiber production and/or post treatment and uses of the fiber, and preferably a side-chain alkyl ether if the bulge is liable to occur. Of course, these may be used as a mixture. In such a case, a mixture ratio is suitably adjusted in accordance with purposes.

The nonionic surfactant includes, for example, polyoxyethylene stearyl ether, polyoxyethylene stearyloleyl ether, polyoxyethylene oleyl ether, polyoxyethylene lauryl ether, polyoxyethylene octyl ether, polyoxyethylene isostearyl ether, polyoxypropylene stearyl ether and polyoxypropylene lauryl ether. In view of the fiber smoothness and the slippage of yarn coils,polyoxyethylene stearyl ether, polyoxyethylene lauryl ether and polyoxyethylene isostearyl ether are favorable.

The content of the nonionic surfactant in the oil according to the present invention is preferably in a range from 5 to 50 wt %. If the content is less than 5 wt %, it is difficult to sufficiently increase the coefficient of fiber-fiber static friction to result in a yarn package having a large bulge. Contrarily, if it exceeds 50 wt %, the smoothness is deteriorated to be liable to generate fluff and yarn breakage during the spinning or the false-twist texturing process. The content is more preferably in a range from 6 to 30 wt %.

(b) Required Conditions (Q)

Compounds which are a second component of the oil defined by the required conditions (Q) are ionic surfactants. The ionic surfactant is a component effective for imparting the fiber with the destaticization, the resistance to wear, the emulsification and the corrosive protection, for properly increasing the coefficient of fiber-fiber static friction and for restricting the slippage of yarn coils to prevent the bulge from generating.

While any of anionic surfactants, cationic surfactants or amphoteric surfactants may be used as the ionic surfactant, the anionic surfactant is particularly favorable because antistatic property, resistance to wear, emulsification and corrosive protection can be imparted to the fiber while maintaining the heat durability. Of course, two kinds or more of these surfactants may be combined with each other.

The ionic surfactant includes compounds (k) to (n) represented by the following formula, which are effective for imparting an antistatic property, a resistance to wear, an emulsification and a corrosive protection;

$$R_5—SO_3—X \quad (k)$$

$$(R_6—O))P(=O)(OX)_2 \quad (l)$$

$$(R_7—O—)(R_8—O—)P(=O)(OX) \quad (m)$$

$$R_9—COO—X \quad (n)$$

wherein $R_5$ to $R_9$ represent a hydrogen atom or an organic group having 4 to 30 carbon atoms. The organic group may be hydrocarbon or that in which part or all of hydrocarbon radicals are replaced by groups having hetero atoms such as ester groups, hydroxyl groups, amide groups, carboxyl groups, halogen groups or sulfonate groups or elements of hetero atoms. The hydrocarbon group having 8 to 18 carbon atoms is preferable. X represents alkaline metal or alkaline earth metal.

Particularly, the compound of the chemical structure defined in (k) to (n) and having a ramification wherein $R_5$ to $R_9$ are —C (—$R_{10}$) (-$R_{11}$) or —C (—$R_{12}$) (—$R_{13}$) (—$R_{14}$) is preferably contained as the ionic surfactant in the oil for the purpose of suppressing the fiber-fiber slippage to maintain a favorable package shape when the yarn is wound in a cheese shape. Examples of concrete structures of these compounds are as follows.

$$X—OOCCH(—R_{15})CH_2COO—X$$

$$R_{16}—OOCCH(-SO_3—X)CHCOO—R_{17}$$

$$R_{18}—OOCCH(-R_{19})CH_2COO—X$$

wherein $R_{10}$ to $R_{19}$ are hydrogen atoms or organic groups having 3 to 30 carbon atoms. In this respect, the organic group may be hydrocarbon or that in which part or all of hydrocarbon radicals are replaced by groups having hetero atoms such as ester groups, hydroxyl groups, amide groups, carboxyl groups, halogen groups or sulfonate groups or elements of hetero atoms. A hydrocarbon group having 8 to 18 carbon atoms is preferable. X represents an alkaline metal or an alkaline earth metal.

The content of these ionic surfactants in the oil is preferably in a range from 1 to 8 wt % for the purpose of suppressing the contamination of a heater during the false-twist texturing process and imparting the fiber with the above-mentioned antistatic property and slippage-restricting effect without injuring the smoothness of the fiber. If the content is less than 1 wt %, the antistatic property, the resistance to wear, the emulsification and the corrosive protection become insufficient as well as the coefficient of fiber-fiber static friction becomes so low that the yarn coils are liable to slip to result in an inferior package having a large bulge. Contrarily, if it exceeds 8 wt %, the friction becomes too high and the contamination of the heater is significant whereby fluff and yarn breakage are liable to generate during the spinning or the false-twist texturing process. The content is more preferably in a range from 1.5 to 5 wt %.

(c) Required Conditions (R)

Compounds which are a third component of the oil are one kind or more of fatty ester or polyether-1 defined by the required conditions (R).

These compounds are effective for enhancing the smoothness of PTT fiber and reducing the coefficient of fiber-metal dynamic friction as well as improving the fiber-fiber static friction and resistance to wear. Of them, fatty polyester is particularly effective for enhancing the smoothness and polyether-1 improves the strength of an oil film and is effective for increasing the fiber-fiber static friction and resistance to wear. A ratio of these components may be suitably selected in accordance with the uses of the fiber to be produced. The fatty ester referred to herein is that having a molecular weight in a range from 300 to 700.

The fatty ester includes various synthetic products and natural oils. Of them, synthetic fatty ester having a linear structure is particularly favorable for the purpose of improving the smoothness.

The synthetic fatty ester includes monoester, diester, triester, tetraester, pentaester, hexaester or others. In view of the smoothness, monoester, diester and triester are preferably used. If the molecular weight of the fatty ester is less than 300, the strength of oil film becomes so low as to easily be removed from the fiber surface to lower the smoothness or the vapor pressure becomes so low that the oil is vaporized during the process to contaminate the working environment. Contrarily, if the molecular weight of the fatty ester exceeds 700, the viscosity of the oil becomes so high as to unfavorably lower the smoothness and the sizing ability. Thus, the fatty ester having the molecular weight in a range from 350 to 500 is the most preferable because it is most excellent in smoothness.

Examples of the preferable synthetic product include isooctyl stearate, octyl stearate, octyl palmitate, oleyl laurate, oleyl oleate, lauryl oleate, dioleyl adipate and glycerin ester trilaurate. Of course, two kinds or more of these fatty esters may be combined with each other. On account of the smoothness, fatty ester composed of monovalent carboxylic acid such as octyl stearate, oleyl oleate or lauryl oleate and monovalent alcohol is particularly favorable.

To improve the heat durability, fatty ester having the molecular weight in a range from 400 to 600 is preferably used. In such a case, part of hydrogen atoms may be replaced with groups having hetero atom such as oxygen atom or sulfur atom; for example, ether group, ester group, thioester group or sulfide group.

Polyether-1 referred to herein is one represented by the following formula:

$$R_1—O—(CH_2CH_2O)_{n1}—(CH(CH_3)CH_3O)_{n2}—R_2$$

wherein $R_1$, $R_2$ represent a hydrogen atom or an organic group having 1 to 50 carbon atoms, and n1, n2 are each an integer in a range from 1 to 50).

The organic group may either be hydrocarbon group or a group in which part or all of hydrocarons are replaced with hydroxy group or a group having hetero atom such as halogen atom or element thereof. Preferably, $R_1$ and $R_2$ are hydrogen atom or aliphatic alcohol having 5 to 18 carbon atoms.

In polyether-1, propylene oxide unit and ethylene oxide unit may either be of the random-copolymerization or block-copolymerization with each other. A mass ratio of [propylene oxide unit]/[ethylene oxide unit] is preferably in a range from 20/80 to 70/30 resulting in that the friction-restriction effect is enhanced. More preferably, the mass ratio of [propylene oxide unit]/[ethylene oxide unit] is in a range from 40/60 to 60/40. The molecular weight of polyether-1 is preferably in a range from 1300 to 3000. In this case, n1 and n2 are properly selected in accordance with the molecular weights. The selection of the molecular weight is important. If the molecular weight is less than 1300, the friction-restriction effect becomes insufficient, while if it exceeds 3000, the coefficient of static friction of the fiber becomes excessively lower to result in a badly-shaped yarn package.

In the required conditions (R), a sum of polyether-1 and fatty ester is preferably in a range from 40 to 70 wt %. If the sum is less than 40 wt %, problems may occur in that the fiber smoothness is lowered and the friction and resistance to wear of the fiber sometimes deteriorate to generate fluff and yarn breakage during the spinning and the false-twist texturing process. Contrarily, if it exceeds 70 wt %, the fiber is extremely slippery to be liable to cause the slippage of yarn coils to result in a badly-shaped package.

(d) Required Conditions (S)

Compounds which are a fourth component of the oil defined by the required conditions (S) are polyether-2.

Polyether-2 functions to increase the strength of oil film. Accordingly, it is effective for improving the fiber-fiber static friction and resistance to wear, and therefore favorably used.

Polyether-2 referred to herein is one represented by the following formula:

$$R_3—O—(CH_2CH_2O)_{n1}—(CH(CH_3)CH_2O)_{n2}—R_4$$

wherein $R_3$, $R_4$ represent a hydrogen atom or an organic group having 1 to 50 carbon atoms, and n1, n2 are each an integer in a range from 50 to 1000.

In polyether-2, propylene oxide unit and ethylene oxide unit may either be of the random-copolymerization or block-copolymerization with each other. A mass ratio of [propylene oxide unit]/[ethylene oxide unit] is in a range from 20/80 to 80/20, and the molecular weight of polyether-2 is in a range from 5000 to 50000. In this case, n1 and n2 are properly selected in accordance with the molecular weights. If the molecular weight exceeds 50000, polyether-2 may become in a solid phase or may cause the coefficient of friction to increase.

Polyether-2 may be used in the oil of the present invention if necessary, preferably at the content of 10 wt % or less. If it exceeds 10 wt %, the fiber is excessively slippery to cause the slippage of yarn coils resulting in a badly-shaped package.

According to the oil satisfying the required conditions (P) to (S) described above, a sum of the contents of the components satisfying these required conditions is preferably in a range from 50 to 100 wt % relative to the total amount of the oil, more preferably from 60 to 100 wt %. Therefore, components other than the above-mentioned ones may be contained in the inventive oil at a ratio not injuring the object of the present invention, i.e., at 50 wt % or less.

Such components of oil are not specifically limited, however, for the purpose of improving a slippage of yarn and a spread of oil on yarn surface, they may be mineral oils, fatty esters and polyethers other than described in the required conditions (R), silicon compounds, for example, dimethyl silicone and those wherein part of methyl groups of dimethyl silicone are added with ethylene oxide and/or propylene oxide in a range from 3 to 100 mols via alkyl groups, and amine oxides having organic groups with 5 to 18 carbon atoms. Ester compounds other than defined in the present invention may be contained, such as esters having ether groups, although not limited thereto. Also, known preservatives, anticorrosives or antioxidants may be contained.

The oil of the above-mentioned components may be adhered to the fiber without being diluted or as an emulsion finishing agent dispersed in water. To prevent the oil from irregularly adhered to the fiber or to have a good-shaped package, the oil is adhered to the fiber as an aqueous emulsion preferably in a range from 1 to 20 wt %, more preferably from 2 to 10 wt %, furthermore preferably from 3 to 7 wt %. If a ratio of the oil is less than 1 wt %, it is liable to be difficult to evenly maintain a temperature of the fiber at a predetermined value due to heat of vaporization since an amount of vaporized water on a first hot roll is excessively large. As a result, the irregularity of heat treatment and/or uneven dyeing are liable to occur. Contrarily, if the oil ratio exceeds 20 wt %, it is liable to be difficult to evenly adhere the oil to the fiber because the emulsion finishing agent is high in viscosity and less in amount when a predetermined amount of oil is imparted to the fiber.

A pickup of the oil relative to the fiber is preferably in a range from 0.2 to 3 wt %. If the pickup is less than 0.2 wt %, the oil is not so effective so that fibers in a yarn are separated from each other due to static electricity and yarn breakage or fluff is liable to occur due to friction. Contrarily, if it exceeds 3 wt %, the resistance becomes larger when the fiber runs and the oil is liable to adhere to rolls, hot plates or guides to contaminate the same. When the fiber is subjected to the false-twist texturing process, the pickup is preferably in a range from 0.25 to 1.0 wt %, more preferably from 0.3 to 0.7 wt %. Of course, part of the oil may penetrate the interior of the fiber.

(iii) Coefficient of Friction of PTT Fiber

According to the present invention, a value calculated from the following equation based on a coefficient F/Fμs of fiber-fiber static friction and a total fiber size d (dtex) is referred to as a coefficient G of static friction corrected by a fiber size. The value G is preferably in a range from 0.06 to 0.25 in the present invention.

$$G=(F/F\mu s)-0.00383\times d$$

F/Fμs is a parameter representing the liability to generate fluff due to the rubbing between fibers and the easiness of slippage between yarn coils. Since this value is proportional to a contact area between fibers, it is also variable in correspondence to the fiber sizes. Accordingly, the value G is favorably in the above-mentioned range.

If the value G is less than 0.06, the fiber wound on a bobbin is liable to slip which may generate the bulge or the collapse of yarn coils.

Figure 3A:
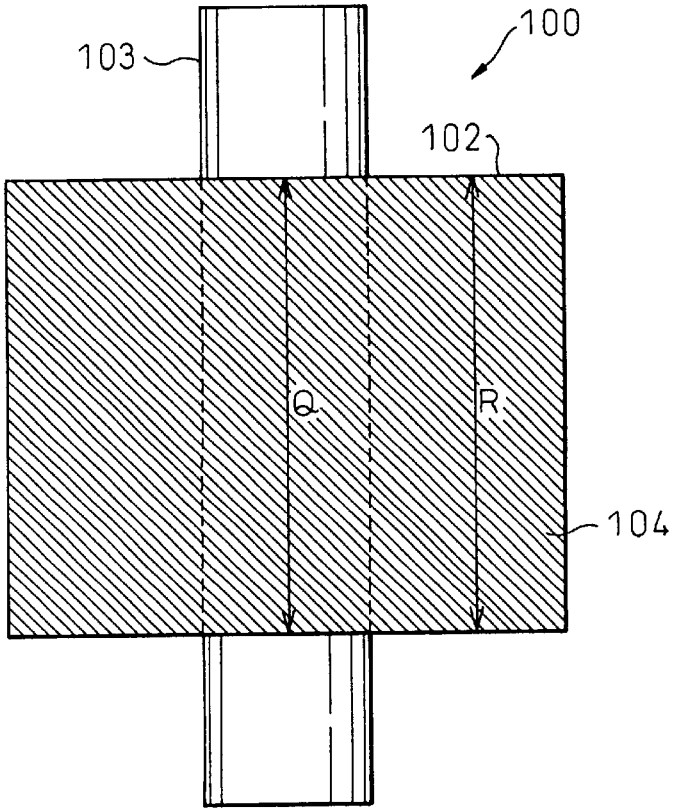
FIG. 3(A) is a schematic illustration of a cheese-shaped package (of a favorable shape) formed by winding a PTT fiber according to the present invention on a bobbin.
Figure 3B:
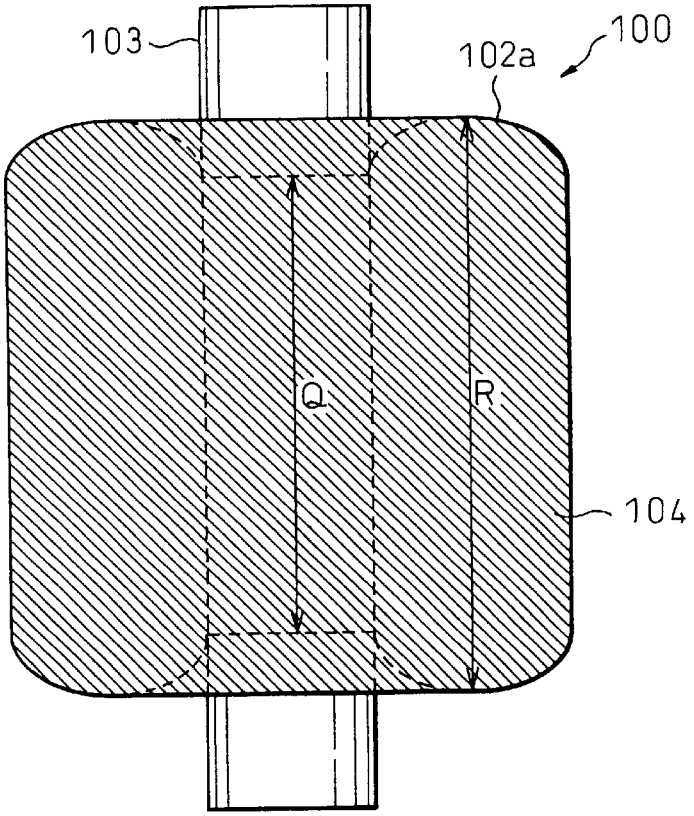
FIG. 3(B) is a schematic illustration of a bulged cheese-shaped package (of an unfavorable shape)

The bulge is, as shown in FIG. 3(B), a swollen end face (102*a*) of a cheese-shaped yarn package (100) caused by a strong tightening force of the yarn coils in the package due to the fiber shrinkage.

On the other hand, if the value G exceeds 0.25, fluff and yarn breakage are liable to occur during the yarn unwinding or the draw false-twist texturing process. The value G is more preferably in a range from 0.1 to 0.2, further more preferably from 0.12 to 0.18.

While the coefficient G of static friction corrected by a fiber size preferably satisfies the above-mentioned range, a coefficient F/Mμd of fiber-metal dynamic friction is favorably in a range from 0.15 to 0.30. F/Mμd is a parameter representing not only the easiness of slippage between fiber and metallic part such as rolls and hot plates but also between fiber and guides, a disk or a belt of a false-twist texturing machine. If this value is less than 0.15, a friction between the fiber and the disk or belt of the false-twist texturing machine becomes sometimes too low to sufficiently twist the yarn. Contrarily, if it exceeds 0.30, the fiber is liable to be difficult to slip on the hot plate or the guide to cause fluff and yarn breaks. The more preferable range of this value is from 0.17 to 0.27.

According to the present invention, a coefficient F/Fμd of fiber-fiber dynamic friction is preferably in a range from 0.3 to 0.65. The coefficient of fiber-fiber dynamic friction is a parameter representing the liability to generate fluff due to the rubbing between fibers. If this value is less than 0.3, the fiber sometimes becomes excessively slippery to disturb the spinning and drawing operation. Contrarily, if it exceeds 0.65, the friction sometimes becomes excessively high to generate fluff and yarn breakage.

Factors for varying the coefficient of friction are the crystallinity and orientation of fiber, kinds and pickups of oil and the content of water. The above-mentioned favorable range of the coefficient of friction is achievable by the adjustment of these items according to the present invention.

(iv) Titanium Oxide and U %

To carry out the draw false-twist texturing process in a stable manner without the generation of fluff and yarn breakage, the fiber preferably contains titanium oxide of a certain ratio determined not to disturb the texturing operation and is uniform in the lengthwise direction. For this purpose, PTT fiber preferably contains titanium oxide having an average particle size in a range from 0.01 to 2 μm at a ratio in a range from 0.01 to 3 wt %, wherein the content of aggregates of the titanium oxide particles having the longest length exceeding 5 μm is 12 pieces/mg-fiber or less, and U % is in a range from 0 to 2%.

The description will be made below in this respect.

PTT fiber according to the present invention preferably contains titanium oxide having an average particle size in a range from 0.01 to 2 μm at a ratio in a range from 0.01 to 3 wt % as a delusterant as well as for the purpose of reducing the coefficient of friction. PTT has a larger coefficient of friction than those of PET and PBT. Therefore, fluff and yarn breakage are liable to occur during the spinning or false-twist texturing process. If the fiber contains titanium oxide, it is possible to reduce the coefficient of friction and suppress the generation of fluff and yarn breakage during the spinning or false-twist texturing process. If the content of titanium oxide is 0.01 wt %, the effect for reducing the coefficient of friction is smaller or the luster becomes so high that the appearance is cheap-looking. On the other hand, if it exceeds 3 wt %, not only the effect for reducing the coefficient of friction has been saturated, but also titanium oxide particles are stripped off from the fiber to contaminate the spinning machine or the winder. The content is favorably in a range from 0.03 to 2 wt %.

The content of aggregates of titanium oxide particles having the longest length exceeding 5 μm in the inventive PTT fiber is preferably 12/mg of fiber (this unit represents the number of aggregates contained in a fiber of 1 mg weight) or less. This is because if this condition is satisfied, it is possible to reduce the irregularity of physical properties of the fiber such as an elongation at break or others. This value is more preferably 10/mg of fiber or less, further more preferably from 7/mg of fiber.

U % of the inventive PTT fiber is preferably in a range from 0 to 2%.

Figure 4:
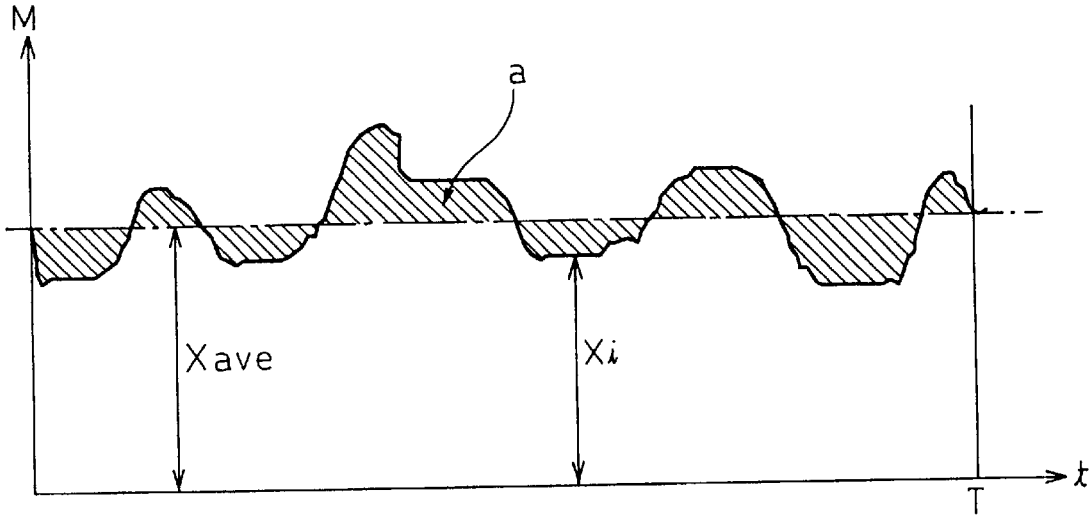
FIG. 4 is an irregularity curve (representing the variation of fiber mass) obtained when the fiber passes an USTER TESTER 3.

The U % is a value obtained from the variation of mass of a fiber sample measured by USTER TESTER 3 manufactured by Zellweger Uster Co. Ltd. This device is capable of measuring the mass variation due to the change of dielectric constant when the fiber sample passes a gap between electrodes. When the fiber sample passes through the device at a constant speed, a curve representing the unevenness of fiber sample is obtained as shown in FIG. 4. In the drawing, M is a mass, t is a time, Xi is an instantaneous value of the mass, Xave is an average value of the instantaneous values of the mass, T is a measurement time and a is an area between Xi and Xave (a hatched portion in FIG. 4). U % could be obtained therefrom by using the following equation:

$$U\,\%=[a/(X\mathrm{ave}\times T)]\times 100$$

If the U % exceeds 2%, fluff and yarn breakage are liable to occur during the false-twist texturing process or result in a low-quality false-twist textured yarn having uneven dyeing and/or crimp irregularity. The U % is preferably 1.5% or less, more preferably 1.0% or less. Of course, the lower the U %, the better the yarn quality.

(v) Strength

The strength of the inventive PTT fiber is preferably 1.3 cN/dtex or more. If it is less than 1.3 cN/dtex, the fiber is so weak that fluff and yarn breakage are liable to generate during the unwinding or draw false-twist texturing of the yarn.

The strength is more preferably 1.5 cN/dtex or more, further more preferably 1.7 cN/dtex or more.

(vi) The Inventive PTT Fiber is Preferably of a Multifilamentary Yarn Form.

While there is no limitation in a total fiber size thereof, it is preferably in a range from 5 to 400 dtex, more preferably from 10 to 300 dtex. While there is no limitation in a single-fiber size, it is preferably in a range from 0.1 to 20 dtex, more preferably from 0.5 to 10 dtex, further more preferably from 1 to 5 dtex.

There is no limitation in a cross-sectional shape of the fiber, and it may be circular, polygonal such as triangular, flat, of an L-shape, a W-shape, a cross-shape, a parallel-crosses shape or a dog-bone shape. Also, it may either be solid or hollow.

(3) Cheese-shaped Package

The inventive PTT fiber is preferably wound in a form of a cheese-shaped package.

To modernize and rationalize the false-twist texturing process, a large package is preferable, that is, a larger amount of the fiber is preferably wound in a cheese-shaped package. The cheese-shaped package is capable of minimizing the fluctuation of a yarn tension when the yarn is unwound therefrom during the draw false-twist texturing process to achieve the stable yarn-processing.

(i) Bulging Percentage

The cheese-shaped package of the inventive PTT fiber preferably has a bulging percentage of 20% or less.

FIG. 3(A) shows a desirable form of the cheese-shaped package (100) wherein the yarn is wound on a bobbin (103) as cylindrical yarn layers (104) to have a flat end face (102).

As shown in FIG. 3(B), a bulge is a swollen end face (102*a*) of the cheese-shaped package (100) formed when a large tension is applied to the package due to the fiber shrinkage during the winding. The bulging percentage is a value calculated by the following equation (2) based on a winding width Q of the innermost yarn layer and a winding width R of the most swollen part in FIG. 3(A) or FIG. 3(B):

$$\text{Bulging percentage}=[(R-Q)/Q]\times 100 \quad (2)$$

The bulging percentage is a parameter representing a degree of package tightness due to fiber shrinkage.

If the bulging percentage of the cheese-shaped package exceeds 20%, the package tightness due to fiber shrinkage becomes so large that the removal of the package from a spindle of the winder may often be impossible. Also, there are many yarn breakage, fluff and uneven dyeing in the resultant yarn due to the fluctuation of unwinding tension. The bulging percentage is preferably 15% or less, more preferably from 10% or less.

(ii) Bobbin

It is very important to reduce the frequency for replacing bobbins during the spinning operation when the yarn is produced in the industrial scale in view of the improvement in working efficiency and the cost saving. After one cheese-shaped package has been exhausted in the draw false-twist texturing process, a leading yarn in a new cheese-shaped package is connected to the former. Also in this case, it is very important to reduce the frequency of the connection in view of the improvement in working efficiency and the cost saving.

Therefore, the cheese-shaped package preferably has 2 kg or more of the inventive PTT fiber, more preferably 3 kg or more, further more preferably 5 kg or more.

If the package is less than 2 kg, the frequency of the bobbin replacement or the yarn connection becomes too high to effectively produce the false-twist textured yarn on an industrial scale.

Material of the bobbin used in the present invention is either of resin such as phenolic resin, metal or paper.

In the case of paper, a thickness is preferably 5 mm or more. A diameter of the bobbin is preferably in a range from 50 to 250 mm, more preferably from 80 to 150 mm. A winding width Q of the fiber on the bobbin is preferably in a range from 40 to 300 mm, more preferably from 60 to 200 mm. If such a bobbin and a winding width as mentioned above are adopted, it is possible to easily obtain a nice cheese-shaped package from which a yarn is smoothly unwound.

(iii) Relaxed Shrinkage

A relaxed shrinkage of PTT fiber wound in the cheese-shaped package according to the present invention is preferably in a range from 0 to 3.0%. The relaxed shrinkage is represented by the following equation:

$$\text{Relaxed shrinkage } (\%)=[(L_0-L_1)/L_0]\times 100$$

wherein $L_0$ represents a length (cm) of fiber in the cheese-shaped package and $L_1$ represents a length (cm) of fiber after the same is unwound from the cheese-shaped package and left in a free state for 7 days.

The relaxed shrinkage represents a potential of the fiber for shrinking on the bobbin and is a parameter for indicating the package tightness due to fiber shrinkage. If the relaxed shrinkage exceeds 3.0%, the fiber largely shrinks to cause the package tightness due to fiber shrinkage. If this value is negative, the fiber slackens to cause the collapse of yarn coils. The relaxed shrinkage is preferably in a range from 0.1 to 2.5%, more preferably from 0.2 to 2.0%, further more preferably from 0.3 to 1.5%.

(4) Method for Production of PTT Fiber

Next, as an example, one method for obtaining the inventive PTT fiber and the cheese-shaped package thereof will be described below.

The PTT fiber according to the present invention is obtained by extruding PTT, in a melted state, essentially composed of repeating units of trimethylene terephthalate of 90 mol % or more from a spinneret to be a multifilamentary yarn which is then quickly cooled and solidified. The solidified multifilamentary yarn is treated with heat at a temperature in a range from 50 to 170° C., and then wound up while maintaining a tension in a range from 0.02 to 0.2 cN/dtex at a speed in a range from 2000 to 4000 m/min.

A favorable method for producing the inventive PTT fiber will de described in more detail with reference to FIGS. 5, 6(A), 6(B), 6(C) and 6(D).

In the above-mentioned drawings, reference numeral 1 denotes a dryer; 2 an extruder; 3 a bend; 4 a spin head; 5 a spinning pack; 6 a spinneret; 7 a warmed region; 8 a multifilamentary yarn; 9 a cooling air; 10 a finishing agent applicator; 11 a first roll; 12 a free roll; 13 a winder; 13*a* a spindle and a package; 13*b* a touch roll; 14 a spinning chamber; 15 a heat-treatment zone; 16 a second roll; 17 a first nelson roll; 18 a second nelson roll; 19 a first heater; and 20 a second heater.

1) First, PTT pellets dried to a moisture content of 100 ppm or less in the dryer 1 are fed to the extruder 2 preset at a temperature in a range from 250 to 290° C. and melted therein. The melted PTT is sent to the spin head 4 disposed subsequently to the extruder and preset at a temperature in a range from 250 to 290° C. and is weighed by a gear pump. Thereafter, the melted PTT is extruded as a melted multifilamentary yarn into the spinning chamber 14 through the spinneret (also referred to as a spinning nozzle) 6 having a plurality of holes and mounted to the pack 5.

The moisture content of the PTT pellets fed to the extruder is preferably 50 ppm or less, more preferably from 30 ppm or less for the purpose of preventing the degree of polymerization from lowering.

While a temperature of the extruder and the spin head must be selected within the above-mentioned range in accordance with the intrinsic viscosities or shapes of the PTT pellets, which range is more preferably from 255 to 285° C., further more preferably from 260 to 280° C. If the temperature of the extruder or the spin head is 250° C. or lower, yarn breakage and fluff may generate and the yarn diameter may be irregular. Contrarily, if the temperature of the extruder or the spin head exceeds 290° C., the thermal decomposition becomes significant whereby the resultant yarn may sometimes be discolored or have an unsatisfactory strength.

2) The melted multifilamentary yarn extruded into the spinning chamber 14 from the spinneret 6 is cooled by the cooling air 9 to a room temperature and converted to a solidified multifilamentary yarn 8.

A spinning draft when the PTT is extruded from the spinneret is preferably in a range from 60 to 2000. In this regard, the spinning draft is a value represented by the following equation:

$$\text{Spinning draft}=V_2/V_1$$

wherein $V_1$ is a linear speed (m/min) of the polymer when extruded from the spinneret, and $V_2$ is a peripheral speed (m/min) of the first roll. If the first roll is not used, $V_2$ represents a winding speed.

The melted multifilamentary yarn extruded from the spinneret is drafted while it is quickly cooled to be the solidified multifilamentary yarn. Since PTT is softer than PET or others and has a lower Tg, the melted multifilamentary yarn state lasts longer and a zone in which it is drafted is also longer. Accordingly, it will be unevenly drafted if an air resistance is large and irregular as in a case of POY wound at high speed.

Thus, the spinning draft representing a draft ratio applied to the PTT from the extrusion to the solidification thereof is an important parameter for the purpose of minimizing the fluctuation of physical properties such as U % or elongation at break. If the spinning draft is controlled within the above-mentioned range, the U % will easily be minimized.

If the spinning draft exceeds 2000, the fluctuation of physical properties such as U % or elongation at break becomes larger, whereby fluff and yarn breakage are liable to generate during a high speed draw false-twist texturing process. On the other hand, if the spinning draft is less than 60, a diameter of a spinning nozzle hole becomes excessively small to result in a high extrusion pressure causing an unstable extrusion and, in the worst case, a melt fracture may occur to cause the physical properties, such as U % or elongation at break, to fluctuate. Further, since the winding speed is excessively slow, the orientation and the elongation at break is outside the range suitable for the inventive PTT-POY. Thereby, fluff and yarn breakage are liable to generate during a high speed draw false-twist texturing process. The spinning draft is preferably in a range from 100 to 1500, more preferably from 150 to 1000.

Preferably, after the melted multifilamentary yarn has passed through the warmed region 7 having a length in a range from 2 to 80 cm and maintained at an environmental temperature in a range from 30 to 200° C. not to be excessively promptly cooled, it is quickly cooled and converted to a solidified multifilamentary yarn. By passing through the warmed region 7, the melted multifilamentary yarn could be converted to the solidified multifilamentary yarn while suppressing various irregularities (such as a thickness unevenness, orientation unevenness or an elongation unevenness) even at a high winding speed (or a high peripheral speed of the first roll).

If the temperature in the warmed region 7 is lower than 30° C., the melted multifilamentary yarn is so quickly cooled that the irregularities of the solidified multifilamentary yarn are liable to increase. Contrarily, if it exceeds 200° C., the yarn breakage is liable to occur. The warmed region is preferably maintained at a temperature in a range from 40 to 180° C., more preferably from 50 to 150° C. The length of the warmed region is more preferably in a range from 5 to 30 cm.

3) Next, prior to being subjected to the heat treatment at a certain temperature, the solidified multifilamentary yarn is preferably applied with a finishing agent by a finishing agent applicator 10.

By the application of the finishing agent, the cohesiveness, antistatic property and slipperiness of the fibers are improved to restrict the generation of fluff and yarn breakage during the drawing, winding and post-treatment and maintain a favorable form of the resultant package.

The finishing agent referred to herein includes an aqueous emulsion in which oil is emulsified by using an emulsifying agent, a solution in which oil is dissolved in a solvent or an oil itself, and serves for improving the cohesiveness, antistatic property and slipperiness of fibers. As for the composition, concentration and pickup of the finishing agent or oil, the description of [(II) (ii)] made on the inventive PTT fiber should be referred to.

The finishing agent may be applied by various methods, while using a known oiling roll or a guide nozzle disclosed in Japanese Unexamined Patent Publication No. 59-116404. To prevent yarn breakage or fluff from generating due to friction of the finishing agent applicator itself, the guide nozzle is preferably used. The finishing agent may be applied to fibers at any position within the chamber 14, the heat-treatment zone 15 before the first roll 11 and between both the zones. Especially, a position close to the spinneret is favorable, after the melted multifilamentary yarn has been cooled to a room temperature by the cooling air 9 to be the solidified multifilamentary yarn 8. As the fibers are collected simultaneously after being applied with the finishing agent, it is possible to minimize the air resistance to as small as possible if the above-mentioned position is as close as possible to the spinneret, whereby fluff and yarn breakage can be prevented from generating.

4) Preferably, the moisture content of the fibers, after being wound up, is in a range from 0.5 to 5 wt %.

This moisture may be water contained in the finishing agent and applied to the fibers via the finishing agent, or may be applied, separately from the finishing agent, to the fibers prior to being wound by means of a guide nozzle similar to that used for the application of the finishing agent. The moisture content of the fibers is more preferably in a range from 0.7 to 4 wt %, further more preferably from 1 to 3 wt %. When the moisture content is within the above range, a good cheese-shaped package is easily obtainable, having no slip-off of yarn coils on the end surface of the package and free from the generation of bulge.

5) Next, the solidified multifilamentary yarn 8 is heated in the zone 15 by the first roll 11 or others. In this respect, the free roll 12 is a roll which is not self-driven.

While the inventive PTT fiber may be directly wound by the winder after being heated with a heater or others, without using rolls or others, it is preferably wound by the winder after once being wrapped around a rotating roll, because the winding tension is easily controllable by adjusting speeds of the roll and the winder.

Figure 5:
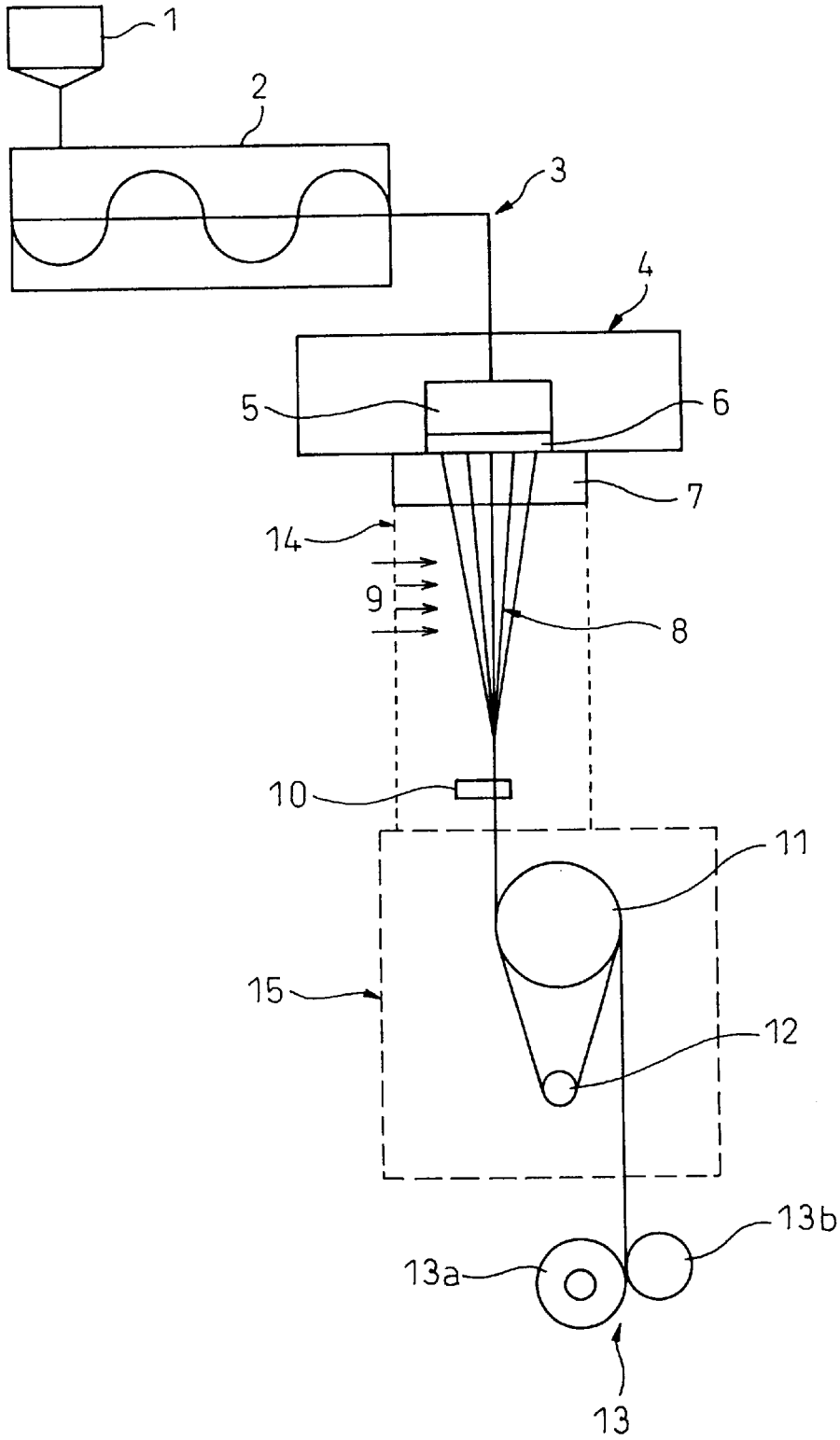
FIG. 5 is a schematic view of an illustration of a spinning machine used for producing a PTT fiber according to the present invention.
Figure 6A:
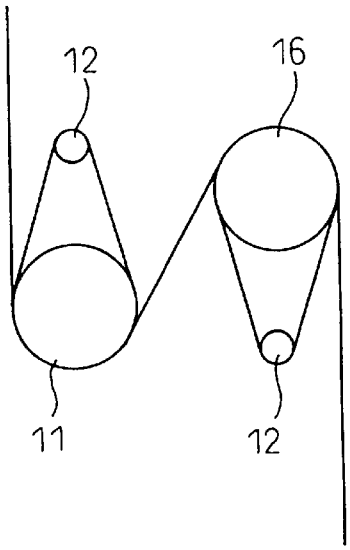
FIGS. 6(A) to 6(D) are illustrations, respectively, of a heat treatment zone in a spinning machine for producing a PTT fiber according to the present invention.
Figure 6B:
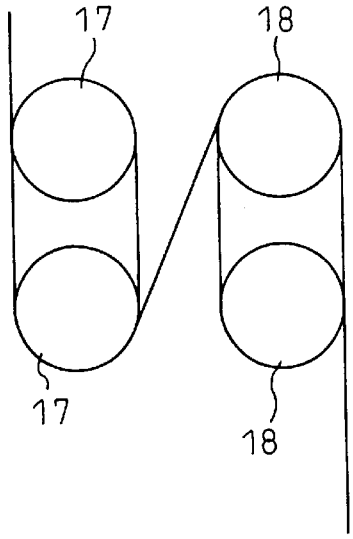
Figure 6C:
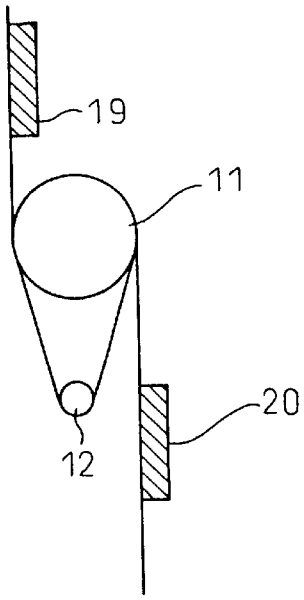

There are methods for heating the fiber other than that shown in FIG. 5 wherein the first roller 11 is solely used. For example, FIG. 6(A) shows that the fiber is heated by a first roll 11 and/or a second roll 16; FIG. 6(B) shows that the fiber is heated by either one or both of first nelson rolls 17 or second nelson rolls 18; FIG. 6(C) shows that the fiber is heated a first heater 19 and/or a second heater 20; and FIG. 6(D) shows that the fiber is heated by a first heater 19.

Figure 6D:
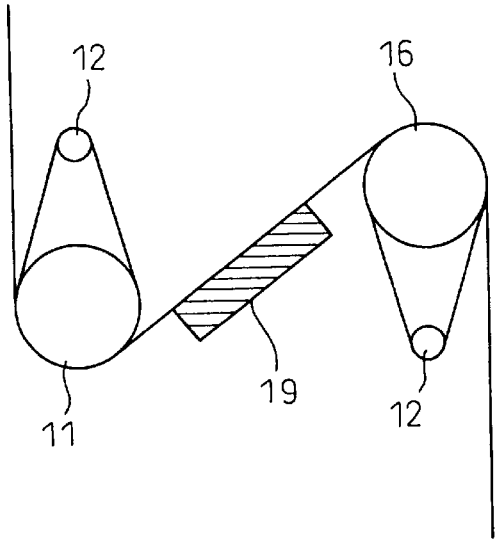

In the cases shown in FIGS. 6(C) and 6(D), the fiber may be heated by the roll (rolls) in addition to the heater (heaters).

The heater for heating the fiber may be either of a contact type or a non-contact type. Also, a heated gas may be used. Of them, the method using the heated roll is the most favorable because the speeds of the roll and the winder is adjustable simultaneously with the heat treatment.

Although the self-driving roll is solely heated while the free roll is not used for the heating in the illustrated embodiments wherein the fiber is heated by the rolls, the free roll may of course be used for the heating.

It is necessary that the heating temperature is in a range from 50 to 170° C. If the temperature is lower than 50° C., it is impossible to crystallize the fiber to a sufficient degree whereby the package tightness due to fiber shrinkage may occur or physical properties of the fiber may vary with time to disturb the draw false-twist texturing process on an industrial scale. Contrarily, if it exceeds 170° C., the crystallinity of the fiber becomes so high that the coefficient of fiber-fiber static friction is excessively small to result in a large bulging percentage or a difficulty in draw false-twist texturing at a high speed. The heat treatment temperature is preferably in a range from 60 to 150° C., more preferably from 80 to 130° C.

A heat treatment time is preferably in a range from 0.001 to 0.1 second. The heat treatment time referred to herein is a total time if a plurality of rolls and/or heaters are used. If the heat treatment time is less than 0.001 second, it is impossible to crystallize the fiber to a sufficient degree whereby the package tightness due to fiber shrinkage or the bulge may occur or physical properties of the fiber may vary with time. Contrarily, if it exceeds 0.1 second, the crystallinity of the fiber becomes so high that the coefficient of fiber-fiber static friction is excessively small to result in a large bulging percentage in the resultant cheese-shaped package.

In the present invention, when the heating temperature is high, or the heating time is long, or the winding speed is high, the crystallinity of the fiber becomes high. Accordingly, the heating time is preferably selected in accordance with the heating temperature and/or the winding speed.

6) Winding (Formation of Cheese-shaped Package)

The multifilamentary yarn subjected to the heat treatment is wound up by using the winder 13.

It is necessary that the winding speed is in a range from 2000 to 4000 m/min. If the winding speed is lower than 2000 m/min, the orientation of the fiber is too low to obtain PTT-POY having a peak value of thermal stress and a density within a range defined by the present invention even though the heat treatment has been carried out under any condition, whereby the resultant fiber becomes brittle and the handling and the draw false-twist texturing of the fiber is difficult. Contrarily, if it exceeds 4000 m/min, the orientation and the crystallinity of the fiber are developed too much to obtain PTT-POY having a peak value of thermal stress and a density within a range defined by the present invention, whereby the fiber largely shrinks on the bobbin to cause package tightness. The winding speed is preferably in a range from 2200 to 3800 m/min, more preferably from 2500 to 3600 m/min.

In the present invention, it is necessary that the winding tension is in a range from 0.02 to 0.20 cN/dtex. When PET or nylon is melt-spun in the prior art, the yarn could not run in a stable state under such a low winding tension and may leave a traverse guide to cause yarn breakage or a switching mistake when the yarn is automatically switched from the full-wound bobbin to a next fresh bobbin.

Surprisingly, however, PTT fiber can be wound at the above-mentioned extremely low tension without causing such a problem. Only under such a low winding tension, it is possible to obtain a good cheese-shaped package free from package tightness due to fiber shrinkage. If the winding tension is lower than 0.02 cN/dtex, the tension is so low that the yarn is not smoothly subjected to the traverse motion by the traverse guide to result in a badly-formed package or generate the yarn breakage due to the yarn leaving a traverse guide. If the winding tension exceeds 0.20 cN/dtex, the package tightness due to fiber shrinkage may occur even though the fiber is wound after being heat-treated.

The winding tension is preferably in a range from 0.025 to 0.15 cN/dtex, more preferably from 0.03 to 0.10 cN/dtex.

When the first roll is used, the peripheral speed thereof is preferably adjusted so that the winding tension is within the above-defined range. Usually, the peripheral speed is preferably 0.90 to 1.1 times the winding speed.

Auxiliary rolls may be provided either, or both, in front of or behind the first roll to additionally carry out the heat treatment, deflect the yarn or control the tension. In such a case, it is preferable that the fiber is not drafted 1.3 times or more between the respective rolls. When the auxiliary roll is provided behind the first roll, the peripheral speed of the former is preferably adjusted to control the winding tension within the above range.

According to the present invention, an interlacing treatment may be carried out during the spinning process if necessary. The interlacing treatment may be carried out prior to the application of the finishing agent, the heat treatment or the winding operation, or may be carried out at a plurality of locations.

A winder used for the present invention may be of a spindle-drive type, a touch roll-drive type or a combination type thereof. Of them, the combination type is favorable because a large amount of yarn can be wound.

When either one of the touch roll or the spindle is self-driven, the other is frictionally driven by a driving shaft, whereby the bobbin attached to the spindle has a peripheral speed different from that of the touch roll due to the slippage between the two. For this reason, when the yarn is transferred from the touch roll to the spindle, the yarn may be stretched or slackened to vary the tension, resulting in the badly-formed cheese-shaped package or a scrubbed and damaged yarn. By driving both of the spindle and the touch roll, the difference in peripheral speed between the touch roll and the bobbin is controllable to reduce the slippage whereby the yarn quality and the package form become desirable.

In the present invention, a surface temperature of the cheese-shaped package being wound is preferably maintained in a range from 0 to 50° C. If the surface temperature even locally exceeds 50° C., the fiber shrinks to generate the package tightness and, since such a temperature of more than 50° C. exceeds the Tg of the fiber, the fiber may deform whereby it is difficult to obtain a high-quality false-twist textured yarn without generating fluff and yarn breakage. The surface temperature is preferably in a range from 5 to 45° C., more preferably from 10 to 40° C.

To maintain the surface temperature of the cheese-shaped package in a range from 0 to 50° C., cooling air may be applied to the cheese-shaped package being wound. To maintain a good-looking package shape, the yarn is preferably wound at an adequate cross-winding angle under a proper contact pressure while keep the surface temperature in a range from 0 to 50° C.

The cross-winding angle is preferably in a range from 3.5 to 8 degrees. If the traverse angle is less than 3.5 degrees, the angle made between yarn coils is so small that the yarn coil at an end of the cheese-shaped package is liable to slide to cause the slip-off of yarn coils and the bulge. Contrarily, if it exceeds 8 degrees, since a more yarn is wound at an end of the bobbin, a diameter of the package is larger at both ends compared with a middle area thereof. Accordingly, the end portions of the package are solely in contact with the touch roll to deteriorate the yarn quality, or when the yarn is unwound from the package, the yarn tension largely fluctuates to generate fluff and yarn breakage. The cross-winding angle is more preferably in a range from 4 to 7 degrees, further more preferably from 5 to 6.5 degrees.

The contact pressure is preferably in a range from 1 to 5 kg per one cheese-shaped package. The contact pressure is a load to be applied to the cheese-shaped package by the touch roll of the winder during the winding operation. If the contact pressure exceeds 5 kg per one cheese-shaped package, the temperature of the cheese-shaped package is liable to be higher and a force applied to the fiber becomes larger, whereby the fiber is damaged and deformed. If the contact pressure is less than 1 kg per one cheese-shaped package, the vibration of the winder becomes larger and in an extreme case, the winder may be broken. The contact pressure is preferably in a range from 1.2 to 4 kg, more preferably from 1.5 to 3 kg.

(5) False-twist Textured Yarn

A false-twist textured yarn according to the present invention is obtained by draw false-twist texturing the inventive PTT fiber, that is PTT-POY, which is very soft in touch and excellent in elastic recovery. This false-twist textured yarn also can maintain such features for a long period.

The inventive false-twist textured yarn preferably has a crimp elongation in a range from 150 to 300%, the number of crimps in a range from 4 to 30/cm, and the number of snarls in a range from 0 to 3/cm. The false-twist textured yarn having the crimp elongation, the number of crimps and the number of snarls within the above-defined ranges is soft in touch and excellent in elastic recovery which are features of the PTT as well as good in processibility, for example, when woven or knitted, whereby a fabric having a good-looking surface is obtainable.

If the crimp elongation is less than 150% or the number of crimps is smaller than 4/cm, the softness or the elastic recovery becomes insufficient and the bulkiness is poor to result in a textured yarn of a filament-like touch without swelling or a light feeling. Contrarily, if the crimp elongation exceeds 300% or the number of crimps exceeds 30/cm, the processibility, for example, when woven or knitted becomes worse to result in a fabric rough and limp in touch which is far from the soft touch inherent to PTT. The crimp elongation and the number of crimps are preferably in a range from 170 to 280% and from 8 to 27/cm, respectively, and more preferably in a range from 150 to 250% and from 12 to 25/cm, respectively.

If the number of snarls exceeds 3/cm, the snarled yarn coils are entangled with each other to increase the yarn tension when the false-twist textured yarn is unwound from the package, and in an extreme case, the yarn is broken. Even though not resulting in yarn breakage, the unwinding tension largely fluctuates to deteriorate the weavability or the knittability. The number of snarls is more preferably in a range from 0 to 2/cm. Of course, 0/cm is most favorable.

A crimp modulus of elasticity is preferably in a range from 80 to 100%. If it is within this range, a high-grade fabric having a very good stretchability is obtainable. The crimp modulus of elasticity is more preferably in a range from 85 to 100%, further more preferably from 90 to 100%.

While the false-twist textured yarn is used for manufacturing a fabric through the weaving or knitting process, it is favorably applied with oil again prior to being wound, for enhancing the weavability or the knittability. This oil may be mixed with the spinning oil formerly adhered to the fiber. In such a case, the oil adhered to the false-twist textured yarn is a total of the spinning oil and a fresh oil applied during the false-twist texturing process.

The oil used at this stage preferably contains 70 to 100 wt % of fatty ester having a molecular weight in a range from 300 to 800 and/or mineral oil having a Redwood viscosity in a range from 20 to 100 seconds at 30° C. If the molecular weight of the fatty ester is less than 300 or the Redwood viscosity of the mineral oil is less than 20 seconds, the oil viscosity is too low to enhance the weavability or knittability. On the other hand, if the molecular weight of the fatty ester exceeds 800 or the Redwood viscosity of the mineral oil exceeds 100 seconds, the oil viscosity is so high that fluff and yarn breakage are liable to occur during the weaving or knitting process and the loom or knitting machine is liable to be contaminated thereby. More preferably, the oil contains a fatty ester having a molecular weight in a range from 400 to 700 and/or a mineral oil having a Redwood viscosity in a range from 30 to 80 seconds at 30° C. If the content of the fatty ester and/or the mineral oil in the applied oil is less than 70 wt %, the slipperiness and/or the stain resistance are liable to lower. The content is more preferably in a range from 90 to 99.5 wt %. To enhance the weavability or knittability, such an oil is preferably adhered to the false-twist textured yarn in a range from 0.5 to 5 wt %, more preferably from 1 to 3 wt %.

The inventive false-twist textured yarn is preferably wound in a package form. In such a case, the package of the false-twist textured yarn preferably has a hardness in a range from 70 to 90 and a winding density in a range from 0.6 to 1.0 g/cm$^3$. If the hardness is less than 70 or the winding density is less than 0.6 g/cm$^3$, the slip-off of yarn coils may occurs or the package may deform due to the vibration encountered during the transportation, or the yarn coils are entangled with each other to increase the unwinding tension too much and, in an extreme case, cause yarn breakage. On the other hand, if the hardness exceeds 90 or the winding density exceeds 1.0 g/cm$^3$, a so-called bulge phenomenon in which both ends of the package are swollen outward may occur to increase the unwinding tension, resulting in the yarn breakage or the difference in crimpability between inner and outer layers of the package, which deteriorates the quality of the woven and/or knitted fabric. The hardness is more preferably in a range from 75 to 90, and the winding density is more preferably in a range from 0.65 to 0.95 g/cm$^3$.

The above-mentioned false-twist textured yarn and the package thereof are obtainable by using the inventive PTT-POY and cheese-shaped package thereof. Since the inventive PTT-POY has the orientation and crystallinity in a particular range and can be unwound from the cheese-shaped package at a low unwinding tension as well as a small tension fluctuation as described above, a false-twist texturing temperature, a draw ratio, the number of twists and a ratio of a disk speed to a yarn speed are properly selectable.

(6) Method for Producing False-twist Textured Yarn

For carrying out the false-twist texturing process, various types of false-twist texturing machines may be used, including a pin type, a friction type and air-twisting type. Of them, in view of the characteristic of the inventive PTT-POY, the friction type capable of carrying out the draw false-twist texturing process at a high productivity is preferably used, including a disk type or a belt-nip type.

A processing speed is preferably 200 m/min or more, more preferably 300 m/min or more, further more preferably 500 m/min or more, on account of the productivity.

A processing temperature is preferably in a range from 100 to 210° C. in a case of a touch type heater. If the processing temperature is lower than 100° C., it is difficult to impart the fiber with sufficient crimps. Contrarily, if it exceeds 210° C., fluff and yarn breakage are liable to occur. When a non-touch type heater is used, as a preferable temperature varies in accordance with distances between the heater and the fiber, it is favorable to select the temperature of the non-touch type heater so that the fiber is imparted with heat corresponding to that from the touch type heater. The temperature in the touch type heater is more preferably from 140 to 200° C., further more preferably from 150 to 190° C.

A draw ratio during the false-twist texturing process is preferably adjusted so that an elongation of the false-twist textured yarn is in a range from 40 to 50%. In this case, the draw ratio is approximately in a range from 1.05 to 2.0 times.

In a case of the disk type false-twist texturing machine, a twisting disk is preferably made of ceramic or urethane; the number of the disks is preferably in a range from 4 to 8; [disk speed]/[yarn speed] (D/Y ratio) is preferably in a range from 1.7 to 3. Within these ranges, the false-twist textured yarn having the number of crimps within the range defined according to the present invention is easily obtainable.

To obtain a false-twist textured yarn package having a proper hardness and winding density for the purpose of enhance the unwinding of the false-twist textured yarn from the package, it is favorable to regulate the winding tension of the false-twist textured yarn, obtained from the process controlled as above, to be in a range from 0.05 to 0.22 cN/dtex. In this respect, the winding tension is an average value of the tension periodically varying in accordance with the reciprocated motion of the traverse guide.

(7) Fabric

The inventive false-twist textured yarn is excellent in crimp form, softness and elastic recovery. Accordingly, this yarn is converted to a fabric having a smooth and high-grade surface which is good in processibility during the weaving/knitting process, soft feeling in touch, high in stretchability and excellent in bulkiness.

The inventive false-twist textured yarn may be used as part or all of a fabric including a woven fabric such as taffeta, twill, satin, crepe de Chine, palace crepe or georgette crepe, and a knit fabric such as plain knit, rib knit, double rib knit, single tricot or half tricot. Of course, the fabric may be scoured, dyed or heat-set in a usual manner or may be sewn to a clothing.

The fabric in which the inventive false-twist textured yarn is partially used is a mixed fabric in which is used at least one kind selected from synthetic fibers other than the inventive fiber, chemical fibers and natural fibers such as cellulose fiber, wool, silk, stretch fiber or acetate fiber. There is no limitation in a method for mixing such fibers with the inventive false-twist textured yarn, but any known methods may be adopted. For example, the above fibers may be used with the inventive fiber in a woven fabric as warp or weft or reversible fabric and in a knit fabric such as tricot or raschel fabric. And otherwise, the above fibers may be double-twisted, ply-twisted and interlaced with the inventive fiber.

The fabric in which the inventive false-twist textured yarn is partially or totally used is excellent in softness, stretchability, surface smoothness and color development and suitably used for innerwear, outerwear, sportswear, lining cloth or hosiery.

The present invention will be described in more concretely below with reference to the preferred examples, but should not be limited thereto.

In this respect, the measurements or others are as follows:

(1) Content of Titanium Oxide

The content of titanium oxide is measured by using a high-frequency plasma spectrometer IRIS-AP manufactured by Thermogerel Ash (phonetic) wherein an amount of Ti element is determined, from which the content is calculated based on atomic weights of Ti element and oxygen element.

A sample to be analyzed is prepared as follows:

Concentrated sulfuric acid of 15 ml is added to the polymer or fiber of 0.5 g in a conical flask which is then heated on a hot plate at 150° C. for 3 hours and on another hot plate at 350° C. for 2 hours to decompose the same. After being cooled, 5 ml of hydrogen peroxide water is added. After the oxidative decomposition, the liquid is condensed to be a volume of 5 ml, then added to an aqueous solution of concentrated hydrochloric acid/water (volume ratio of 1/1), and further added to 40 ml water to result in the sample.

(2) Average Particle Size of Titanium Oxide

A photograph of a section of the polymer or fiber is taken by using a transmission type electron microscope JEM-2000FX manufactured by NIPPON DENSHI in 2,500–20,000 magnifications. Then, by using an image analyzing apparatus IP-1000 manufactured by ASAHI KASEI, an equivalent diameters of the titanium oxide particles in the photograph are determined, from which an average particle size is obtained.

(3) Aggregate of Titanium Oxide

The polymer or fiber of 1 mg is sandwiched between a pair of cover glasses of 15 mm×15 mm, and melted on a hot plate at 260° C. After being melted, a load of 100 g is applied to the cover glasses to spread the melted polymer while taking care that it does not swell out from the cover glass, and quickly cooled in a cold water.

This sample is magnified 200 times through an optical microscope and a total area of the polymer or fiber is observed. In the observation, pieces exceeding 5 $\mu$m in length are counted. Similar operations are repeated five times, an average value of the respective counts is calculated to be the number of aggregates of titanium oxide.

(4) Intrinsic Viscosity

The intrinsic viscosity [$\eta$] is determined by obtaining a specific viscosity $\eta sp$ in o-chlorophenol at 35° C. by using an Ostwald viscometer, and calculated by the following equation wherein a ratio of the specific viscosity $\eta sp$ to a concentration C (g/100 ml) (ηsp/C) is extrapolated to the concentration zero:

$$[\eta] = \lim_{c \to 0} (\eta sp / C)$$

(5) Density

The density is measured in accordance with JIS-L-1013 by using a density gradient tube prepared from carbon tetrachloride and n-heptane.

(6) Birefringence

The birefringence is obtained in accordance with the Handbook of Fiber; Raw Material Section (the fifth edition, page. 969; published in 1978 by MARUZEN K.K) by using an optical microscope and a compensator based on a retardation of polarized light observed on the fiber surface.

(7) Peak Value of Thermal Stress and Peak Temperature

A thermal stress tester KE-2 manufactured by KANEBO ENGINEERING K.K. is used at an initial load of 0.044 cN/dtex and at a temperature rising rate of 100° C./min. Data obtained therefrom are plotted in a graph having a horizontal axis of temperature and a vertical axis of thermal stress to obtain a temperature-thermal stress curve. A maximum value of a thermal stress is defined as a peak value and a temperature at which the peak value is obtained is defined as a peak temperature.

(8) Shrinkage in Boiling Water

A shrinkage in boiling water is obtained as a hank shrinkage in accordance with JIS-L-1013.

(9) Elongation at Break and Strength at Break

Tensilon which is a constant speed stretching type tensile tester manufactured by ORIENTECH K.K., is used in accordance with JIS-L-1013 at a grab distance of 20 cm and at a stretching rate of 20 cm/min. Twenty samples are measured and average values are adopted as a strength at break and an elongation at break. Also, a standard deviation of the elongation at break is obtained.

(10) Wide Angle X-ray Diffraction (Using an Imaging Plate X-ray Diffraction Device)

A diffraction image is observed by using an imaging plate X-ray diffraction device RINT 2000 manufactured by RIGAKU DENKI K.K. (K.K. RIGAKU) under the following condition, and X-ray diffraction data are processed by a computer to obtain digital data which are printed out on an imaging plate (a kind of photographic plate) as a two-dimensional image to result in an electronic digital photograph. FIGS. 1(A) and 1(B) illustrate the same.

Kind of X-ray: CuKa ray

Camera length: 94.5 mm

Measurement time: 1 to 5 minutes (suitably selectable in accordance with crystallinity of fiber)

(11) Wide Angle X-ray Diffraction (Using a Counter Method)

A diffraction image is observed by using a wide angle X-ray diffraction device ROTORFLEX RU-200 manufactured by RIGAKU DENKI K.K. (K.K. RIGAKU) under the following condition.

Kind of X-ray: CuKa ray

Output: 40 kV, 120 mA

Goniometer: manufactured by RIGAKU DENKI K.K. (K.K. RIGAKU)

Sensor: scintillation counter Count recorder: RINT 2000, Online data processing system Scanning range: 2η=5 to 40 degrees Sampling interval: 0.03 degrees Integrated time: 1 second A true diffraction intensity is calculated from the following equation based on the diffraction intensity obtained by the measurement of the sample and a scattering intensity of air:

True diffraction intensity=(diffraction intensity of sample)−(scattering intensity of air)

(12) Oil Pickup

The fiber is rinsed with diethylether in accordance with JIS-L-1013. After the diethylether is then removed, the mass of residual oil is divided by a fiber mass to obtain an oil pickup on the fiber surface.

(13) Coefficient of Fiber-fiber Static Friction (F/Fμs)

A fiber of approximately 690 m long is wound around a cylinder at a cross-winding angle of approximately 15 degrees with a tension of approximately 10 g with which the same fiber of 30.5 cm long is kept in constant straddling. At that time, the latter fiber is disposed parallel to the wound direction of the former yarn. A gram weight corresponding to 0.04 times of a total fiber size in dtex of the latter fiber is connected to one end of the latter yarn and a strain gauge is connected to the other end thereof.

Next, the cylinder is made to rotate at a peripheral speed of 0.017 mm/sec, and a tension is measured by the strain gauge. From the tension thus obtained, the coefficient f of fiber-fiber static friction is calculated by the following equation:

$$f=(1/\pi)\times\ln(T_2/T_1)$$

wherein $T_1$ is a mass of the weight applied to the fiber, $T_2$ is an average value of data of the tension when measured at least 25 times, ln is a natural logarithm, and π is the ratio of a circumference of a circle to its diameter.

(14) Coefficient of Fiber-fiber Dynamic Friction (F/Fμd)

In the above measurement (13), an f value is referred to as a coefficient of fiber-fiber dynamic friction when the peripheral speed is 18 m/min.

(15) Coefficient of Fiber-metal Dynamic Friction (F/Mμd)

A coefficient of fiber-metal dynamic friction is measured by using a micrometer manufactured by EIKO SOKKI K.K. under the following condition.

The fiber is wrapped on an iron cylinder of 25 mm diameter having a satin-finished chrome surface (a degree of roughness 3s) used as a frictional body while applying a tension of 0.30 cN/dtex, so that an entrance direction and an exit direction of the fiber relative to the frictional body are crossed at 90 degrees. The coefficient μ of dynamic friction of the fiber is obtained when rubbed at a speed of 100 m/min in the environment of 25° C. and 65% RH by the following equation.

$$\mu=[(360\times2.303)/2\pi\theta]\times\log_{10}(T_2/T_1)$$

wherein $T_1$ is an entrance side tension (corresponding to 0.36 g/dtex), $T_2$ is an exit side tension, θ is 90 degrees and π is the ratio of a circumference of a circle to its diameter.

(16) U %

U % is measured by using an USTER TESTER 3 manufactured by Zellweger Uster Co. Ltd. under the following condition:

Measurement speed: 100 m/min

Measurement time: one minute

Number of Measurements: twice

Kind of twist: S-twist

(17) Bulging Percentage

A winding width Q of the innermost yarn layers (104) and a winding width R of the most swollen part shown in FIGS.

3(A) or 3(B) are measured, from which a bulging percentage is calculated by the following equation:

$$\text{Bulging percentage}=[(R-Q)/Q]\times 100$$

(18) Relaxed Shrinkage

A cheese-shaped package on which the fiber is wound for 10 minutes is used for determining a relaxed shrinkage in accordance with the following equation:

$$\text{Relaxed shrinkage (\%)}=[(L_0-L_1)/L_0]\times 100$$

wherein $L_0$ is a length of the fiber (cm) on the cheese-shaped package, and $L_1$ is a length of the fiber (cm) after being unwound from the cheese-shaped package and left in a free state for 7 days.

$L_0$ is calculated based on a diameter and a cross-winding angle of the yarn coil on the cheese-shaped package, while $L_1$ is measured in such a manner that the fiber is unwound from the cheese-shaped package within 30 minutes after being wound thereon, left freely as it is for 7 days, and then a length of the fiber is measured under a load of 1/34 cN/dtex.

(19) Number of Crimps of False-twist Textured Yarn

In accordance with JIS-L-1015, five false-twist textured yarns are heat-treated in air at 90° C. for 15 minutes, and the number of crimps per 25 mm length of each of them is counted. An average value thereof is converted to the number of crimps per 1 cm.

(20) Crimp Elongation of False-twist Textured Yarn

In accordance with JIS-L-1090, the fiber is heat-treated in air at 90° C. for 15 minutes, and a crimp elongation (%) of the false-twist texture yarn is measured by an elongation A-method.

(21) Crimp Modulus of Elasticity of False-twist Textured Yarn

In accordance with JIS-L-1090, the fiber is heat-treated in air at 90° C. for 15 minutes, and a crimp modulus of elasticity (%) of false-twist textured yarn is measured by an elongation A-method.

(22) Number of Snarls of False-twist Textured Yarn

A sample of the false-twist textured yarn is prepared from a package while taking care not to stretch the crimp. A lateral side enlarged photograph of the sample is taken under a load of $1.764\times10^{-3}$ cN/dtex, from which the number of portions wherein a singe filament is twisted to form a loop is counted as snarls. The number of snarls in a yarn length of 75 mm is measured five times, and an average value thereof is converted to the number of snarls per 1 cm.

(23) Redwood Viscosity

A Redwood viscosity is measured in accordance with JIS-K2283-1956.

(24) Hardness of False-twist Textured Yarn Package

A hardness of the false-twist textured yarn is measured by using a spring type hardness tester (Asker rubber hardness tester Type C manufactured by KOBUNSHI KEIKI K.K.) in accordance with JIS-K-6301 of physical test for vulcanized rubber. The hardness is measured at two points in a central area of the package and two points in each of opposite end areas of the package (total six portions), from which an average value is obtained.

(25) Winding Density of False-twist Textured Yarn Package

A mass of fiber wound in the winding package is divided by a volume of the package geometrically obtained on the basis of an outer diameter, a winding width of the package and an outer diameter of a bobbin to have a winding density.

EXAMPLES 1 to 7

Dimethyl terephthalate and 1,3-propane diol were mixed at a mol ratio of 1:2, to which was added titanium tetrabutoxide corresponding to 0.1 wt % of dimethyl terephthalate, whereby an ester exchange reaction was completed under a normal pressure at a heater temperature of 240° C. Then, 0.05 wt % of trimethylphosphate and 0.1 wt % of titanium tetrabutoxide relative to dimethyl terephthalate and 0.5 wt % of titanium dioxide relative to a theoretical amount of the polymer were added and reacted at 270° C. for 3 hours.

Titanium dioxide was of an anatase type crystal having an average particle size of 0.2 μm. This titanium dioxide of 20 wt % was dispersed in 1,3-propane diol by a homogenizer and, after being centrifugally separated at 6000 rpm for 30 minutes, filtrated through a membrane filter of 5 μm. The resultant disperse system was added to a reaction system, while agitating, directly before the addition.

The polymer was heated in a nitrogen atmosphere for solid-phase polymerization to result in polymers having intrinsic viscosities [μ] shown in Table 1. The resultant polymers contain 0.5 wt % of titanium oxide having an average particle size of 0.7 μm, and the number of aggregates of titanium oxide having the longest length exceeding 5 μm was 12, 10 and 10/mg of polymer in Examples 1, 9 and 11, respectively.

The polymer thus obtained was dried in a usual way to reduce the moisture content to 50 ppm, and then, by using the device shown in FIG. 5, melted at an extruder temperature of 265° C. and a spin head temperature of 285° C. and extruded through 36 spinning holes having 0.23 mm diameter in a single arrangement.

The melted multifilamentary yarn thus extruded passed through a warmed region of 5 cm long maintained at 100° C. and then was quickly cooled by cooling air of 20° C. at an air speed of 0.4 m/min to be a solidified multifilamentary yarn.

Next, oil containing 60 wt % of octyl stearate, 15 wt % of polyoxyethylene alkylether and 3 wt % of potassium phosphate was applied to the fiber as an aqueous emulsion type finishing agent of 5 wt % concentration through a guide nozzle so that an oil pickup of 0.7 wt % is obtained relative to the fiber. Subsequently, after being heated under the condition shown in Table 1, the solidified multifilamentary yarn was wound at a winding width of 90 mm on a paper bobbin of 124 mm diameter and 7 mm thick to be a cheese-shaped package of 122 dtex/36f PTT-POY of 6 kg weight under the condition shown in Table 1, by a winder of a type in which both of a spindle and a touch roll are self-driven.

The physical properties of the resultant fibers are shown in Table 2. The resultant fibers are within a scope of the present invention and the generation of fluff and yarn breakage was not discernible during the spinning process. The cheese-shaped packages were easily removable from the spindle of the winder, and the bulging percentage thereof also remained within a favorable range.

EXAMPLE 8

In the same manner as Example 1, a fiber of 56 dtex/24f was obtained under the condition shown in Table 1. Physical properties of the resultant fiber are shown in Table 2.

The resultant fiber is within a scope of the present invention and the generation of fluff and yarn breakage was not discernible during the spinning process. The cheese-shaped packages were easily removable from the spindle of the winder, and the bulging percentage thereof also remained within a favorable range.

EXAMPLES 9 and 10

In the same manner as Example 1, except that 0.1 wt % of a 7:1 mixture of calcium acetate and cobalt acetate 4 hydrate is added, instead of titanium tetrabutoxide, to dimethyl terephthalate and a system shown in FIG. 6(A) is used as a zone for heat-treating the fiber, fibers of 126 dtex/36f were obtained under the condition shown in Table 1, in which the fibers were heated by a second roll 16 shown in FIG. 6(A).

Physical properties of the resultant fibers are shown in Table 2. The resultant fibers were within a scope of the present invention and the generation of fluff and yarn breakage was not discernible during the spinning process. The cheese-shaped packages were easily removable from the spindle of the winder, and the bulging percentage thereof also remained within a favorable range.

EXAMPLE 11

A polymer having an intrinsic viscosity of 0.7 was obtained in the same manner as Example 9 except for copolymerizing 5-sodium sulfoisphthalate of 2 mol %. A fiber of 128 dtex/36f was obtained from the resultant polymer in the same manner as Example 9 under the condition shown in Table 1.

Physical properties of the resultant fibers are shown in Table 2. The resultant fibers were within a scope of the present invention and the generation of fluff and yarn breakage was not discernible during the spinning process. The cheese-shaped packages were easily removable from the spindle of the winder, and the bulging percentage thereof also remained within a favorable range.

Comparative Example 1

By using the polymer resulted from Example 1, a fiber of 122 dtex/36f was obtained in the same manner as in Example 1 under the condition shown in Table 1. Physical properties of the resultant fiber are shown in Table 2.

While the generation of fluff and yarn breakage was not discernible during the spinning process, the resultant fiber is poor both in orientation and crystallinity, whereby the peak value of thermal stress and the elongation at break were out of a scope of the present invention. Also, U % was large.

Comparative Examples 2 and 3

By using the polymer resulting from Example 1, a fiber of 122 dtex/36f was obtained in the same manner as in Example 1 under the condition shown in Table 1. While the generation of fluff and yarn breakage was not discernible during the spinning process, the package tightness due to fiber shrinkage occurred to make it impossible to remove the cheese-shaped package from the winder. After the package grew to approximately 1 kg weight, the fiber samples were collected therefrom on which the physical properties are measured. As a result, it was apparent that no crystalline peak was observed and the density and the shrinkage in boiling water were also out of a scope of the present invention.

By using these fibers, the draw false-twist texturing was carried out one day and one month after being spun. Since the physical properties of the fibers varied during this period, it was impossible to obtain the false-twist texture yarns of the same quality.

Comparative Example 4

By using the polymer resulting from Example 1, a fiber of 122 dtex/36f was obtained in the same manner as in Example 1 under the condition shown in Table 1.

As a result, while the generation of fluff and yarn breakage was not discernible during the spinning process, the package tightness due to fiber shrinkage occurred to enlarge the bulge, which makes it impossible to remove the cheese-shaped package from the winder. After the package grew to approximately 1 kg weight, the fiber samples were collected therefrom on which the physical properties are measured. It was apparent therefrom that the crystallization developed too much and the density was out of a scope of the present invention.

Comparative Example 5

A fiber was obtained in the same manner as in Example 1 except that the heat-treatment was carried out at 180° C.

As a result, while the package tightness due to fiber shrinkage was not generated, the resultant cheese-shaped package had a large bulge and was difficult to handle. The fiber samples were collected therefrom and the physical properties were measured. It was apparent therefrom that the crystallization developed too much and the density and the coefficient of fiber-fiber static friction was out of a scope of the present invention.

Comparative Example 6

A fiber was produced by using the polymer obtained from Example 1 in the same manner as in Example 1.

The polymer thus obtained was dried in a usual way to reduce the moisture content to 40 ppm, and then melted at 285° C. and extruded through 36 spinning holes having 0.23 mm diameter in a single arrangement. The melted multifilamentary yarn thus extruded passed through a warmed region of 8 cm long maintained at 60° C. and then was quickly cooled by cooling air of 20° C. at an air speed of 0.35 m/min to be an undrawn yarn. After the same oil as used in Example 1 was applied thereto as an aqueous emulsion type finishing agent of 10 wt % concentration at an oil pickup of 1 wt % relative to the fiber, the undrawn yarn was wound at a winding speed of 1600 m/min.

The resultant undrawn yarn immediately passed through a preheating roll heated at 55° C. and then passed through a hot plate heated at 140° C. while being drawn at a draw ratio of 3.2 times to result in a drawn yarn of 83 dtex/36f. Physical properties of the resultant yarn are shown in Table 2.

As is apparent from Table 2, since the orientation and crystallization of the drawn yarn developed too much, the density, birefringence and peak value of thermal stress were higher than the upper limit of the scope of the present invention, while the elongation at break was lower than the lower limit of the scope of the present invention. It was impossible to carry out the draw false-twist texturing on this fiber because of the generation of yarn breakage and fluff.

Comparative Example 7

A fiber of 111 dtex/36f was obtained in the same manner as in Comparative example 6 except that the draw ratio was 1.6 times. While the fiber was desired to have substantially the same elongation at break as that of a partially oriented fiber, the irregular drawing was generated to result in a significant unevenness in fiber size. U % of this fiber was as large as 3.5% and the other physical properties varied to a great extent and were difficult to measure.

EXAMPLES 12 to 16

Cheese-shaped packages of 100 dtex/36f yarns in 6 kg weight were obtained in the same manner as in Example 1 except that 36 spinning holes of 0.35 mm diameter in a single arrangement were used, an aqueous emulsion type finishing agent of 5 wt % concentration shown in Table 3 was imparted to the fibers, and the winding speed was 3190 m/min.

Physical properties of the resultant fibers were shown in Table 3. Either of the fibers was within the scope of the present invention and the generation of yarn breakage and fluff was not discernible during the spinning. Also, a cheese-shaped packages thus obtained were easily removable from the spindle of the winder and had a bulging percentage within a favorable range.

EXAMPLE 17

A fiber was obtained in the same manner as in Example 1 under the condition shown in Table 1 by using a polymer added with titanium dioxide of 2.0 wt % relative to a theoretical amount of the polymer. The polymer used for the spinning contained 2.0 wt % of titanium oxide having an average particle size of 0.7 μm and 15/mg of fiber of aggregates of titanium oxide having the longest length exceeding 5 μm. A cheese-shaped package in which the fiber was wound was easily removable from the spindle of the winder and the bulging percentage was also within a favorable range.

The physical properties of the resultant fiber are shown in Table 2. The fiber thus obtained was within the scope of the present invention and the generation of fluff and yarn breakage was not discernible during the spinning.

TABLE 1

| | Intrinsic viscosity [η] | Draft | First roll Temperature ° C. | First roll Peripheral speed m/min | First roll Number of wraps numbers | Winding speed m/min | Winding tension cN/dtex | Cross winding angle ° |
|---|---|---|---|---|---|---|---|---|
| Example 1 | 0.9 | 142 | 90 | 3200 | 6 | 3200 | 0.032 | 5.0 |
| Example 2 | 0.9 | 142 | 90 | 2800 | 6 | 2800 | 0.026 | 5.0 |
| Example 3 | 0.9 | 142 | 55 | 3200 | 10 | 3200 | 0.055 | 5.0 |
| Example 4 | 0.9 | 142 | 140 | 3200 | 2 | 3250 | 0.028 | 5.0 |
| Example 5 | 0.9 | 142 | 100 | 2200 | 20 | 2230 | 0.032 | 5.0 |
| Example 6 | 0.9 | 142 | 90 | 3800 | 3 | 3760 | 0.104 | 5.0 |
| Example 7 | 0.9 | 142 | 90 | 3200 | 5 | 3250 | 0.036 | 6.5 |
| Example 8 | 0.9 | 312 | 90 | 3200 | 4 | 3200 | 0.063 | 5.0 |
| Example 9 | 0.7 | 138 | 120 | 3250 | 5 | 3200 | 0.071 | 4.5 |
| Example 10 | 0.7 | 138 | 80 | 3510 | 5 | 3500 | 0.082 | 4.5 |
| Example 11 | 0.7 | 136 | 80 | 3040 | 5 | 3000 | 0.069 | 4.5 |
| Example 17 | 0.9 | 402 | 90 | 3200 | 6 | 3200 | 0.031 | 5.0 |
| Comparative example 1 | 0.9 | 142 | 140 | 1800 | 20 | 1850 | 0.028 | 5.0 |
| Comparative example 2 | 0.9 | 142 | 30 | 2500 | 6 | 2480 | 0.032 | 5.0 |
| Comparative example 3 | 0.9 | 142 | 30 | 3200 | 6 | 3150 | 0.040 | 5.0 |
| Comparative example 4 | 0.9 | 142 | 70 | 4800 | 3 | 4750 | 0.200 | 5.0 |
| Comparative example 5 | 0.9 | 142 | 180 | 3200 | 3 | 3200 | 0.032 | 5.0 |
| Comparative example 6 | 0.9 | 208 | — | — | — | — | — | — |

TABLE 2

| | Fiber size dtex | Strength cN/dtex | Elongation % | U % % | Density g/m³ | Wide angle X-ray diffraction Crystallinity | Wide angle X-ray diffraction $I_1/I_2$ | Birefringence | Thermal stress Peak value cN/dtex | Thermal stress Peak temperature ° C. | Shrinkage in boiling water % | Friction coefficient F/F μs | Friction coefficient G | Oil pick-up wt % | Bulging percentage % | Relaxed shrinkage % | Removal of bobbin |
|---|---|---|---|---|---|---|---|---|---|---|---|---|---|---|---|---|---|
| Example 1 | 122 | 2.4 | 80 | 0.8 | 1.330 | ○ | 1.8 | 0.054 | 0.032 | 65 | 6 | 0.53 | 0.062 | 0.7 | 9 | 2.3 | ○ |
| Example 2 | 122 | 2.2 | 92 | 1.2 | 1.324 | ○ | 1.5 | 0.050 | 0.037 | 58 | 7 | 0.55 | 0.082 | 0.7 | 5 | 2.1 | ○ |
| Example 3 | 122 | 2.4 | 83 | 0.7 | 1.322 | ○ | 1.3 | 0.060 | 0.077 | 56 | 16 | 0.56 | 0.092 | 0.7 | 7 | 2.7 | ○ |
| Example 4 | 122 | 2.5 | 75 | 1.2 | 1.338 | ○ | 2.3 | 0.049 | 0.019 | 75 | 4 | 0.52 | 0.052 | 0.7 | 17 | 1.4 | ○ |
| Example 5 | 122 | 1.8 | 115 | 1.5 | 1.320 | ○ | 1.1 | 0.032 | 0.022 | 57 | 5 | 0.57 | 0.102 | 0.7 | 8 | 2 | ○ |
| Example 6 | 122 | 2.6 | 65 | 0.7 | 1.330 | ○ | 2.3 | 0.055 | 0.088 | 69 | 9 | 0.52 | 0.052 | 0.6 | 18 | 2.7 | ○ |
| Example 7 | 122 | 2.4 | 78 | 0.8 | 1.332 | ○ | 1.8 | 0.054 | 0.049 | 65 | 6 | 0.53 | 0.062 | 0.7 | 5 | 2.3 | ○ |
| Example 8 | 56 | 2.5 | 75 | 0.9 | 1.335 | ○ | 1.8 | 0.060 | 0.092 | 65 | 5 | 0.33 | 0.117 | 0.7 | 11 | 2.5 | ○ |
| Example 9 | 126 | 2.4 | 84 | 1.0 | 1.332 | ○ | 2.0 | 0.043 | 0.020 | 71 | 4 | 0.54 | 0.059 | 0.6 | 9 | 2.1 | ○ |
| Example 10 | 126 | 2.6 | 78 | 0.9 | 1.324 | ○ | 2.3 | 0.046 | 0.070 | 59 | 8 | 0.55 | 0.069 | 0.7 | 13 | 2.7 | ○ |

TABLE 2-continued

| | Fiber size dtex | Strength cN/dtex | Elongation % | U % % | Density g/m³ | Wide angle X-ray diffraction: Crystallinity | Wide angle X-ray diffraction: $I_1/I_2$ | Birefringence | Thermal stress: Peak value cN/dtex | Thermal stress: Peak temperature ° C. | Shrinkage in boiling water % | Friction coefficient: F/F μs | Friction coefficient: G | Oil pick-up wt % | Bulging percentage % | Relaxed shrinkage % | Removal of bobbin |
|---|---|---|---|---|---|---|---|---|---|---|---|---|---|---|---|---|---|
| Example 11 | 128 | 1.9 | 80 | 1.1 | 1.324 | ○ | 1.5 | 0.044 | 0.034 | 58 | 5 | 0.54 | 0.051 | 0.8 | 8 | 2.2 | ○ |
| Example 17 | 122 | 2.3 | 77 | 0.9 | 1.330 | ○ | 1.8 | 0.054 | 0.032 | 65 | 7 | 0.51 | 0.042 | 0.7 | 8 | 2.3 | ○ |
| Comparative example 1 | 122 | 1.5 | 128 | 2.9 | 1.314 | ○ | 1.1 | 0.026 | 0.007 | 62 | 8 | 0.57 | 0.102 | 0.7 | 2 | 1 | ○ |
| Comparative example 2 | 122 | 1.9 | 100 | 1.0 | 1.312 | X | 0.9 | 0.041 | 0.009 | 56 | 45 | 0.57 | 0.102 | 0.7 | — | 3.5 | X |
| Comparative example 3 | 122 | 2.4 | 80 | 1.5 | 1.316 | X | 0.9 | 0.057 | 0.060 | 56 | 44 | 0.57 | 0.103 | 0.7 | — | 3.9 | X |
| Comparative example 4 | 122 | 2.9 | 55 | 2.1 | 1.344 | ○ | 2.7 | 0.061 | 0.075 | 70 | 8 | 0.53 | 0.062 | 0.6 | — | 4 | X |
| Comparative example 5 | 122 | 2.3 | 74 | 1.5 | 1.346 | ○ | 3.5 | 0.048 | 0.005 | 90 | 3 | 0.46 | −0.008 | 0.6 | 24 | 2 | ○ |
| Comparative example 6 | 83 | 3.6 | 38 | 0.8 | 1.344 | ○ | 3.5 | 0.073 | 0.317 | 160 | 13 | 0.43 | 0.111 | 1.0 | — | — | — |

In this regard, in Table 2, "crystallinity" is represented by ○ if a diffraction peak originated from a crystal face (010) is observed in a method using IP and, by×if a diffraction peak originated from a crystal face (010) is not observed.

"Removal of bobbin" is represented by ○ if the bobbin is removable from the spindle when the fiber of 6 kg weight has been wound and, by×if the bobbin is not removable from the spindle when the fiber of 6 kg weight has been wound.

TABLE 3

| | | Example 12 | 13 | 14 | 15 | 16 |
|---|---|---|---|---|---|---|
| FA | | | | | | |
| Fatty ester | Octyl stearate | | | 66 | 60 | 35 |
| Polyether 1 | EP/PO = 40/60 MW 1300 | 25 | 24 | | | 15 |
| | EP/PO = 50/50 MW 2000 | 40 | 38 | | | |
| | EP/PO = 25/75 MW 2500 | | | | | |
| Polyether 2 | EP/PO = 30/70 MW 5000 | | | | | |
| | EP/PO = 30/70 MW 10000 | | | | | |
| other PE | EP/PO = 50/50 MW 1200 | 11 | 10 | | | |
| Nonionic surfactant | POE-10a Oct-e | | 11 | | | |
| | POE-10a Lau-e | 6 | | | 16 | |
| | POE-10a Ist-e | | | 12 | | 30 |
| | POE-10a Ole-e | | | 8 | 8 | |
| Ionic surfactant | Stearyl SO—Na | 1 | 1 | 1 | 1 | 1.5 |
| | Decyl PO—K | 1 | 1 | 1 | 1 | 1.5 |
| | di-Ste s-suc-2Na | | 2 | | | |
| | 2-Ole suc-2Na | | | | 2 | |
| Others | POE-10a Oct-octa | 15 | 12 | | | |
| | POE-10a Cast-e | | | 10 | 10 | 15 |
| | Modified Silicone | 1 | 1 | 2 | 2 | 2 |
| Spinning state | Wind T (cN/dtex) | 0.06 | 0.06 | 0.06 | 0.06 | 0.06 |
| | Fluffs, Yarn Breakage | ○ | ○ | ○ | ○ | ○ |
| | Package tightness | ○ | ○ | ○ | ○ | ○ |
| | Bulge (%) | 4 | 3 | 5 | 5 | 6 |

TABLE 3-continued

| | | Example | | | | |
|---|---|---|---|---|---|---|
| | | 12 | 13 | 14 | 15 | 16 |
| Processability | Oil pickup (wt %) | 0.41 | 0.40 | 0.38 | 0.38 | 0.39 |
| | Coef-F/F-SF | 0.56 | 0.58 | 0.57 | 0.54 | 0.52 |
| | G value | 0.18 | 0.20 | 0.19 | 0.16 | 0.14 |
| | coef-F/M-DF | 0.25 | 0.28 | 0.18 | 0.18 | 0.21 |
| | Coef-F/F-DF | 0.59 | 0.62 | 0.53 | 0.47 | 0.55 |
| Fiber properties | Fiber size (dtex) | 100 | 100 | 100 | 100 | 100 |
| | Strength (cN/dtex) | 2.4 | 2.4 | 2.4 | 2.4 | 2.4 |
| | Elongation (%) | 79 | 80 | 81 | 83 | 80 |
| | Density (g/cm$^3$) | 1.330 | 1.329 | 1.330 | 1.329 | 1.330 |
| | Birefringence | 0.041 | 0.043 | 0.043 | 0.040 | 0.043 |
| | PV-thermal S (cN/dtex) | 0.03 | 0.03 | 0.03 | 0.03 | 0.03 |
| | BW-Shrinkage (%) | 7 | 7 | 7 | 7 | 7 |
| | Relaxed Shrinkage (%) | 2.3 | 2.4 | 2.2 | 2.2 | 2.4 |
| | $I_1/I_2$ | 1.8 | 1.8 | 1.8 | 1.8 | 1.8 |

(Notes of Table 3)
FA; Components of finishing agent
MW; molecular weight
POE-10a Oct-e; POE 10 mol added octylether
POE-10a Lau-e; POE 10 mol added laulylether
POE-10a Ist-e; POE 10 mol added isostealylether
POE-10a Ole-e; POE 10 mol added oleylether
Stearyl SO—Na; Stearyl sulfonate Na salt
Decyl PO—K; Decyl phosphate K salt
di-Ste s-suc-2Na; Distearyl sulfo-succinate 2Na salt
2-Ole suc-2Na; 2-oleyl succinate 2Na salt
POE-10a Oct-octa; POE 10 mol added octyl octanate
POE-10a Cast-e; POE 10 mol added castol oil ether
Wind T; Winding tension
Coef-F/F-SF; Coefficient of fiber-fiber static friction
Coef-F/M-DF; Coefficient of fiber-metal dynamic friction
Coef-F/F-DF; Coefficient of fiber-fiber dynamic friction
PV-thermal S; Peak value of thermal stress
BW-Shrinkage; Shrinkage in boiling water In this regard, in Table 3, values of "components of finishing agent" in the respective examples are represented by a content (wt %) of each of the components.

EO represents ethylene oxide; PO represents propylene oxide; and POE represents polyoxyethylene.

"EO/PO=40/60; molecular weight 1300" represents that a mass ratio of EO units and PO units is 40/60 and the molecular weight of polyether is 1300 (this is also similar to the others).

Either of the polyethers is a block copolymer and end groups of the polyether are all hydroxyl groups.

"Fluff, yarn breakage" is represented by ○ when many fluff and/or yarn breakage did not generated and, by×when many fluff and/or yarn breakage generated.

"Package tightness due to fiber shrinkage" is represented by ○ when the cheese-shaped package was removable from the spindle of the winder and, by×when the cheese-shaped package was not removable from the spindle of the winder.

EXAMPLES 18 TO 23 AND COMPARATIVE EXAMPLES 8 TO 10

A draw false-twist texturing was carried out on the fibers (raw yarns) obtained by the preceding examples or comparative examples listed in Table 4 by using a FK-6 type false-twist texturing machine manufactured by ISHIKAWA SEISAKUSHO provided with seven ceramic twisting disks under the false-twist texturing condition shown in Table 4. Immediately before being wound, the false-twisted yarns were imparted with an oil of 2 wt % relative thereto, containing 98% of mineral oil having a Redwood viscosity of 60 seconds and 2 wt % of potassium phosphate. The winding tension was 0.08 cN/dtex.

In Examples 18 to 23, there were no fluff and yarn breakage during the draw false-twist texturing, and the resultant false-twist textured yarn had a favorable crimp shape at the same level as for PET, a softness peculiar to PTT and an excellent elastic recovery. Also, the weavability and knittability were very good.

The change in physical properties with time was hardly seen even after three months, and the same quality false-twist textured yarn was obtained under the same condition.

In Comparative example 8, because of the low orientation of the raw yarn, the fiber was brittle to generate many fluffs and yarn breakages during the false-twist texturing, whereby it was impossible to obtain the false-twist textured yarn on an industrial scale.

In Comparative example 9, because of the high crystallinity of the raw yarn, although the false-twist texturing could be carried out, the resultant false-twist textured yarn did not have a favorable crimp shape in the same level as in PET, and was also inferior in stretchability.

In Comparative example 10, since a drawn yarn having high crystallinity and orientation and a low elongation at break was used, it was impossible to carry out the false-twist texturing at a high speed.

EXAMPLE 24

Circular knit fabrics were produced by using the false-twist textured yarns obtained by Examples 18 and 21, respectively, in the following manner.

Eight false-twist textured yarns were fed to a circular knitting machine V-LEC 6 (30 inch diameter and 28 gauge) manufactured by FUKUHARA SEIKI SEISAKUSHO to form a circular knit fabric of an interlock stitch which was then scoured and dyed in a rotary type dyeing machine and dried in a tumbler-type dryer, and finally set in a pin tenter at 160° C. for one minute maintaining a width thereof.

In this regard, the hardness values of the false-twist textured yarn packages obtained by Examples 18 and 21 were 85 and 86, respectively, and the winding density values thereof were 0.81 and 0.82, respectively. No yarn breakage occurred during the unwinding.

Results are shown in Table 4. Either of the resultant circular knit fabrics was a high grade one having a smooth surface and uniform stitches as well as excellent in stretchability, soft in hand touch and rich in voluminous feeling.

TABLE 4

| | Conditions of false-twist texturing process | | | | | | | | | | False-twist texture state, physical properties of textured yarn | | | | |
|---|---|---|---|---|---|---|---|---|---|---|---|---|---|---|---|
| | | Elongation | | Titanium dioxide | | | | | | | | Crimp | | | |
| | Raw yarn | Average value % | Standard deviation % | Content wt % | Aggregate/mg-fiber | Speed m/min | Temperature ° C. | Draw ratio | D/Y ratio | False-twist processibility | Crimp elongation % | modulus of elasticity % | Number of crimps/cm | Number of snarls/cm |
| Example 18 | Example 1 | 80 | 2.1 | 0.5 | 3 | 400 | 160 | 1.25 | 2.3 | ○ | 195 | 94 | 14 | 0.4 |
| Example 19 | Example 2 | 92 | 3.2 | 0.5 | 3 | 400 | 160 | 1.30 | 2.3 | ○ | 210 | 96 | 19 | 1.0 |
| Example 20 | Example 9 | 84 | 2.2 | 0.5 | 3 | 400 | 160 | 1.25 | 2.3 | ○ | 195 | 94 | 15 | 0.5 |
| Example 21 | Example 12 | 79 | 2.7 | 0.5 | 3 | 400 | 170 | 1.25 | 2.3 | ○ | 215 | 95 | 22 | 0.5 |
| Example 22 | Example 14 | 81 | 2.8 | 0.5 | 3 | 600 | 170 | 1.25 | 2.3 | ○ | 190 | 92 | 15 | 0.6 |
| Example 23 | Example 17 | 77 | 4.8 | 2.0 | 7 | 400 | 170 | 1.25 | 2.3 | ○ | 195 | 92 | 18 | 0.4 |
| Comparative example 8 | Comparative example 1 | 128 | 13 | 0.5 | 3 | 400 | 160 | 1.50 | 2.3 | X | — | — | — | — |
| Comparative example 9 | Comparative example 5 | 74 | 7.3 | 0.5 | 3 | 400 | 160 | 1.20 | 2.3 | ○ | 135 | 70 | 7 | 0.3 |
| Comparative example 10 | Comparative example 6 | 38 | 1.7 | 0.5 | 3 | 400 | 160 | 1.05 | 2.3 | X | — | — | — | — |

False-twist processibility:
○: no fluffs and/or yarn breakages occurred.
X: many fluffs and/or yarn breakages occurred, whereby false-twist textured yarn was not obtainable.

CAPABILITY OF EXPLOITATION IN INDUSTRY

The inventive PTT fiber is a PTT-POY having both of proper crystallinity and orientation. Accordingly, it is possible to produce a good cheese-shaped package on an industrial scale with no package tightness due to fiber shrinkage during the winding. Also, since physical properties of the fiber hardly change with time, it is possible to produce the same quality false-twist textured yarn on an industrial scale under the same condition for a long time, even at high speed, in the draw false-twist texturing process.

Since the inventive PTT fiber is obtainable by a single spinning process not accompanied with a drawing process, it is produced at a high producibility and a low cost. Also since a large amount of the fiber can be wound on one package, it is possible to reduce the man-hours necessary for the switching operation during the winding or processing of the fiber, whereby the production could be effectively carried out.

A false-twist textured yarn obtained from the inventive PTT-POY has a soft feeling in hand touch as well as high crimp elongation and crimp modulus of elasticity, and is very suitable for a so-called stretch material. Therefore, it is useful for full course support or alternated panty hose, tights, socks (backing yarn, rib top), jersey, covering yarn of elastic yarn, accompanying yarn of mix-knit type fabric such as panty hose.

What is claimed is:

1. A polytrimethylene terephthalate fiber composed of 90 mol % or more of trimethylene terephthalate repeating units and satisfying the following conditions defined in (A) to (E):

(A) a density is in a range from 1.320 to 1.340 g/cm$^3$ (B) a birefringence is in a range from 0.030 to 0.070

(C) a peak value of thermal stress is in a range from 0.01 to 0.12 cN/dtex (D) a boiling water shrinkage is in a range from 3 to 40%, and (E) an elongation at break is in a range from 40 to 140%.

2. A polytrimethylene terephthalate fiber as defined by claim 1, wherein an intensity of a wide angle X-ray diffraction in the direction vertical to a fiber axis satisfies the following equation:

$$I_1/I_2 \geqq 1.0$$

wherein $I_1$ is a maximum diffraction intensity defined at $2\theta$=15.5 to 16.5 degrees, and $I_2$ is an average diffraction intensity defined at $2\theta$=18 to 19 degrees.

3. A polytrimethylene terephthalate fiber as defined by claim 1 or 2, wherein an oil satisfying the following conditions defined in (P) to (S) is adhered to the fiber in a range from 0.2 to 3 wt %:

(P) the content of one kind or more of nonionic surfactants is in a range from 5 to 50 wt %, which are selected from compounds in which alcohol having 4 to 30 carbon atoms is added with ethylene oxide or propylene oxide;

(Q) the content of ionic surfactant is in a range from 1 to 8 wt %;

(R) one kind or more of fatty ester having a molecular weight in a range from 300 to 700 and/or one kind or more of polyether represented by the following formula (referred to as polyether-1) are contained; in the polyether-1, ethylene oxide unit and propylene oxide unit are copolymerized with each other so that a mass ratio of [propylene oxide unit]/[ethylene oxide unit] is in a range 20/80 to 70/30 and a molecular weight is in a range from 1300 to 3000, wherein a total of contents of the fatty ester and the polyether-1 is in a range from 40 to 70 wt %:

$$R_1—O—(CH_2CH_2O)_{n1}—(CH(CH_3)CH_2O)_{n2}—R_2$$

(wherein $R_1$, $R_2$ represent a hydrogen atom or an organic group having the number of carbons in a range from 1 to 50, and n1, n2 are an integer in a range from 1 to 50); and (S) the content of polyether represented by the following formula (referred to as polyether 2) is 10 wt % or less, in which ethylene oxide unit and propylene oxide unit are copolymerized with each other so that a mass ratio of [propylene oxide unit]/[ethylene oxide unit] is in a range 20/80 to 80/20 and a molecular weight is in a range from 5000 to 50000:

$$R_3—O—(CH_2CH_2O)_{n1}—(CH(CH_3)CH_2O)_{n2}—R_4$$

(wherein $R_3$, $R_4$ represent a hydrogen atom or an organic group having the number of carbons in a range from 1 to 50, and n1, n2 are an integer in a range from 50 to 1000).

4. A polytrimethylene terephthalate fiber as defined by claim 1 or 2, wherein a coefficient G of static friction corrected by a fiber size is in a range from 0.06 to 0.25; the coefficient G is calculated from a coefficient F/Fμs of fiber-fiber static friction and a total fiber size d (dtex), as represented by the following equation (1):

$$G=(F/F\mu s)-0.00383\times d \quad (1).$$

5. A polytrimethylene terephthalate fiber as defined by claim 4, wherein a coefficient F/Mμd of fiber-metal dynamic friction is in a range from 0.15 to 0.30.

6. A polytrimethylene terephthalate fiber as defined by claim 1 or 2, wherein the following conditions defined in (F) and (G) are satisfied:

(F) the content of titanium oxide having an average particle size in a range from 0.01 to 2 μm is in a range from 0.01 to 3 wt %, and the number of aggregates of the titanium oxide particles having the longest length exceeding 5 μm is 12/mg of fiber or less; and (G) the fiber has U % in a range from 0 to 2%.

7. A polytrimethylene terephthalate fiber as defined by claim 1 or 2, wherein a relaxed shrinkage is in a range from 0 to 3% and the fiber is wound to form a cheese-shaped package.

8. A cheese-shaped package formed of the polytrimethylene terephthalate fiber defined by claim 1 or 2, wherein a bulging percentage is 20% or less.

9. A cheese-shaped package as defined by claim 8, wherein a width within which the polytrimethylene terephthalate fiber is wound on a bobbin is in a range from 40 to 300 mm and a weight of the polytrimethylene terephthalate fiber wound on the bobbin is 2 kg or more.

10. A method for producing a polytrimethylene terephthalate fiber by melt-spinning polytrimethylene terephthalate composed of 90 mol % or more of trimethylene terephthalate repeating units, wherein a melted multifilamentary yarn extruded from a spinneret is quickly cooled to be a solidified multifilamentary yarn which, after being heated to a temperature in a range from 50 to 170° C., is then wound on a bobbin at a winding tension in a range from 0.02 to 0.20 cN/dtex and a speed in a range from 2000 to 4000 m/min.

11. A method for producing a polytrimethylene terephthalate fiber, as defined by claim 10, wherein after the melted multifilamentary yarn extruded from the spinneret has been quickly cooled to be the solidified multifilamentary yarn, an oil is imparted to the multifilamentary yarn before being wound on the bobbin at an oil pickup in a range from 0.2 to 3 wt % relative to the multifilamentary yarn.

12. A method for producing a polytrimethylene terephthalate fiber as defined by claim 11, wherein the oil satisfying the following conditions defined by (P) to (S) is imparted:

(P) the content of one kind or more of a nonionic surfactants is in a range from 5 to 50 wt %, which surfactants are selected from compounds composed of alcohol having the number of carbons in a range from 4 to 30 added with ethylene oxide or propylene oxide;

(Q) the content of an ionic surfactant is in a range from 1 to 8 wt %;

(R) one kind or more of fatty ester having a molecular weight in a range from 300 to 700 and/or one kind or more of polyether represented by the following formula (referred to as polyether-1) are contained; in the polyether-1, ethylene oxide unit and propylene oxide unit are copolymerized with each other so that a mass ratio of [propylene oxide unit]/[ethylene oxide unit] is in a range 20/80 to 70/30 and a molecular weight is in a range from 1300 to 3000, wherein a total of contents of the fatty ester and the polyether-1 is in a range from 40 to 70 wt %:

$$R_1—O—(CH_2CH_2O)_{n1}—(CH(CH_3)CHO)_{n2}—R_2$$

(wherein $R_1$, $R_2$ represent a hydrogen atom or an organic group having the number of carbons in a range from 1 to 50, and n1, n2 are an integer in a range from 1 to 50); and (S) the content of polyether represented by the following formula (referred to as polyether-2) is 10 wt % or less, in which ethylene oxide unit and propylene oxide unit are copolymerized with each other so that a mass ratio of [propylene oxide unit]/[ethylene oxide unit] is in a range from 20/80 to 80/20 and a molecular weight is in a range from 5000 to 50000:

$$R_3—O—(CH_2CH_2O)_{n1}—CH(CH_3)CH_2O)_{n2}—R_4$$

(wherein $R_3$, $R_4$ represent a hydrogen atom or an organic group having the number of carbons in a range from 1 to 50, and n1, n2 are an integer in a range from 50 to 1000).

13. A method for producing a polytrimethylene terephthalate fiber as defined by any one of claims 11 to 12, wherein the fiber is imparted with an oil by an aqueous emulsion of a concentration in a range from 2 to 10 wt %.

14. A method for producing a polytrimethylene terephthalate fiber as defined by any one of claims 11 to 13, wherein a polymer satisfying the following condition defined in (L) is extruded from the spinneret so that a draft during the spinning process is in a range from 60 to 2000:

(L) the content of titanium oxide having an average particle size in a range from 0.01 to 2 μm is in a range from 0.01 to 3 wt %, and the number of aggregates of the titanium oxide particles having the longest length exceeding 5 μm is 25/mg of polymer or less.

15. A false-twist textured yarn formed of a polytrimethylene terephthalate fiber as defined by claim 1 or 2.

16. A false-twist textured yarn formed of a polytrimethylene terephthalate fiber as defined by claims 1 or 2, wherein the following conditions defined in (M) to (O) are satisfied:

(M) a crimp stretchability is in a range from 150 to 300%;

(N) the number of crimps is in a range from 4 to 30/cm; and (O) the number of snarls is in a range from 0 to 3/cm.

17. A false-twist textured yarn as defined by claim 16, wherein the number of crimps is in a range from 8 to 25/cm.

18. A false-twist textured yarn as defined by claim 16, wherein the following condition defined in (K) is satisfied:

(K) the content of titanium oxide having an average particle size in a range from 0.01 to 2 $\mu$m is in a range from 0.01 to 3 wt %, and the number of aggregates of the titanium oxide particles having the longest length exceeding 5 $\mu$m is 12/mg of fiber or less.

19. A false-twist textured yarn as defined by claim 16, wherein an oil containing fatty ester having a molecular weight in a range from 300 to 800 and/or mineral oil having a Redwood viscosity at 30° C. in a range from 20 to 100 seconds is adhered to the false-twist textured yarn at an oil pickup in a range from 0.5 to 5 wt % relative to the false-twist textured yarn.

20. A false-twist textured yarn package, wherein the false-twist textured yarn defined by claim 16 is wound on a bobbin.

21. A false-twist textured yarn package as defined by claim 20, wherein a hardness of the package is in a range from 70 to 90 and a winding density is in a range from 0.6 to 1.0 g/cm$^3$.

22. A method for producing a false-twist textured yarn, wherein the polytrimethylene terephthalate fiber as defined by claim 1 or 2, is subjected to a draw false-twist texturing process.

23. A method for producing a false-twist textured yarn, wherein the cheese-shaped package as defined by claim 8, is subjected to a draw false-twist texturing process.

24. A fabric wherein the false-twist textured yarn as defined by claim 15, is used as part or all thereof.

* * * * *